US010636394B2

(12) United States Patent
Takahashi

(10) Patent No.: US 10,636,394 B2
(45) Date of Patent: Apr. 28, 2020

(54) HAMMER ASSEMBLY, KEYBOARD INSTRUMENT, AND HAMMER

(71) Applicant: YAMAHA CORPORATION, Hamamatsu-shi (JP)

(72) Inventor: Ken Takahashi, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/536,424

(22) Filed: Aug. 9, 2019

(65) Prior Publication Data

US 2019/0362692 A1 Nov. 28, 2019

Related U.S. Application Data

(63) Continuation of application No. PCT/JP2018/011411, filed on Mar. 22, 2018.

(30) Foreign Application Priority Data

Mar. 24, 2017 (JP) ..... 2017-058742

(51) Int. Cl.
*G10C 3/18* (2006.01)
*G10C 3/12* (2006.01)

(52) U.S. Cl.
CPC *G10C 3/18* (2013.01); *G10C 3/12* (2013.01)

(58) Field of Classification Search
CPC ..... G10C 3/16; G10C 3/12; G10H 1/346
See application file for complete search history.

(56) References Cited

U.S. PATENT DOCUMENTS 8,080,721 B2 * 12/2011 Shimoda ..... G10C 3/12 84/423 R

FOREIGN PATENT DOCUMENTS

| | | |
|---|---|---|
| JP | H11265177 A | 9/1999 |
| JP | 2003186475 A | 7/2003 |
| JP | 2009109601 A | 5/2009 |
| JP | 2015087591 A | 5/2015 |

OTHER PUBLICATIONS

International Search Report issued in Intl. Appln. No. PCT/JP2018/011411 dated May 22, 2018. English translation provided.
Written Opinion issued in Intl. Appln. No. PCT/JP2018/011411 dated May 22, 2018. English translation provided.
International Preliminary Report on Patentability issued in Intl. Appln. No. PCT/JP2018/011411 dated Oct. 3, 2019. English translation provided.

* cited by examiner

*Primary Examiner* — Kimberly R Lockett
(74) *Attorney, Agent, or Firm* — Rossi, Kimms & McDowell LLP

(57) ABSTRACT

A hammer assembly includes: a pivot member that pivots about a pivot axis; and a weight supported by the pivot member and including a plate portion. The plate portion has a first surface and a second surface opposite to the first surface. The plate portion has: a first region with a thickness defined by a length between the first surface and the second surface in a pivot-axis direction at a portion farthest from the pivot axis; and a second region with a thickness greater than that in the first region. In a case where the areas of the first region and the second region on a projected plane when the first region and the second region are viewed in the pivot-axis direction are compared with each other, the area of the first region is less than the area of the second region.

13 Claims, 15 Drawing Sheets

HAMMER ASSEMBLY, KEYBOARD INSTRUMENT, AND HAMMER

CROSS REFERENCE TO RELATED APPLICATION

The present application is a continuation application of International Application No. PCT/JP2018/011411, filed on Mar. 22, 2018, which claims priority to Japanese Patent Application No. 2017-058742, filed on Mar. 24, 2017. The contents of these applications are incorporated herein by in their entirety.

BACKGROUND

The present disclosure relates to a technique for a hammer, a hammer assembly including a weight, and a keyboard instrument including the hammer assembly.

Patent Document 1 (Japanese Patent Application Publication No. 2009-109601) discloses a mechanism which includes a key and an arm portion provided with a weight and in which when the key is pressed, the arm portion pivots about a support point to bring the weight into contact with an upper-limit stopper.

SUMMARY

In the technique disclosed in Patent Document 1, however, when the weight is moved in a pivot-axis direction (a direction along a pivot axis for the weight), a portion of the weight which is located far from the pivot shaft more easily comes into contact with an adjacent weight.

Accordingly, an aspect of the disclosure relates to reduction of contact between adjacent hammers or hammer assemblies.

In one aspect of the disclosure, a hammer assembly comprises: a pivot member configured to pivot about a pivot axis; and a weight supported by the pivot member and comprising a plate portion extending in a direction intersecting the pivot axis, the weight having a specific gravity greater than that of the pivot member. The plate portion comprises a first surface and a second surface opposite to the first surface. The plate portion comprises: a first region with a thickness defined by a length between the first surface and the second surface in a pivot-axis direction at a portion farthest from the pivot axis; and a second region with a thickness greater than that in the first region, and in a case where the areas of the first region and the second region on a projected plane when the first region and the second region are viewed in the pivot-axis direction are compared with each other, the area of the first region is less than the area of the second region.

In another aspect of the disclosure, a hammer comprises: a pivot member configured to pivot about a pivot axis; and a weight supported by the pivot member and having a specific gravity greater than that of the pivot member. The hammer assembly further comprises a plate portion comprising at least the weight and extending in a direction intersecting the pivot axis. The plate portion comprises a first surface and a second surface opposite to the first surface. The plate portion comprises: a first region with a thickness defined by a length between the first surface and the second surface in a pivot-axis direction at a portion farthest from the pivot axis; and a second region with a thickness greater than that in the first region, and in a case where the areas of the first region and the second region on a projected plane when the first region and the second region are viewed in the pivot-axis direction are compared with each other, the area of the first region is less than the area of the second region.

In yet another aspect of the disclosure, a keyboard instrument according to the present disclosure comprises: a plurality of hammer assemblies each as the hammer assembly; and a plurality of keys each configured to cause pivotal movement of a corresponding one of the plurality of hammer assemblies when pressed.

In yet another aspect of the disclosure, a hammer according to the present disclosure is configured to pivot about a pivot axis. The hammer comprises a plate portion extending in a direction intersecting the pivot axis. The plate portion comprises a first surface and a second surface opposite to the first surface. The plate portion comprises: a first region with a thickness defined by a length between the first surface and the second surface in a pivot-axis direction at a portion farthest from the pivot axis; and a second region with a thickness greater than that in the first region. In a case where the areas of the first region and the second region on a projected plane in the pivot-axis direction are compared with each other, the area of the first region is less than the area of the second region.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIG. 7A is a view corresponding to a view in which FIG. 5 is viewed in a direction indicated by arrow P and in which the hammer assembly is viewed from a front side.

FIG. 9 is a view corresponding to a view in which FIG. 5 is viewed in a direction indicated by arrow Q and in which the hammer assembly is viewed from a lower side;

EMBODIMENTS

First Embodiment

Figure 1:
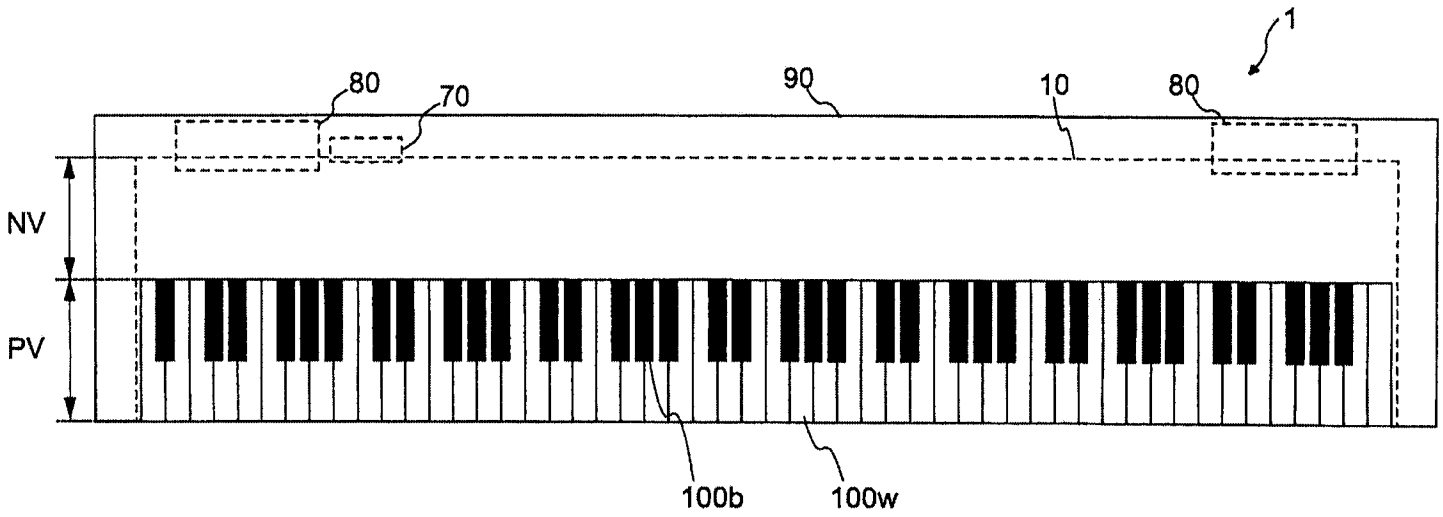
FIG. 1 is a view of a configuration of a keyboard apparatus (a keyboard instrument) according to a first embodiment of the present disclosure.

Hereinafter, there will be described embodiments of the present disclosure by reference to the drawings. It is to be understood that the following embodiments of the present disclosure are described by way of example, and the present disclosure should not be construed as limited to these embodiments. It is noted that the same or similar reference numerals (e.g., numbers with a character, such as A or B, appended thereto) may be used for components having the same or similar function in the following description and drawings, and an explanation of which may be dispensed with. The ratio of dimensions in the drawings (e.g., the ratio between the components and the ratio in the lengthwise, widthwise, and height directions) may differ from the actual ratio, and portions of components may be omitted from the drawings for easier understanding purposes.

Configuration of Keyboard Apparatus

FIG. 1 is a view of a configuration of a keyboard apparatus 1 (a keyboard instrument) according to a first embodiment of the present disclosure. In the present example, a keyboard apparatus 1 is a keyboard instrument (an electronic keyboard instrument), such as an electronic piano, configured to produce a sound when a key is pressed by a player (a user). It is noted that the keyboard apparatus 1 may be a keyboard-type controller configured to output data (e.g., MIDI) for controlling an external sound source device, in response to key pressing. In this case, the keyboard apparatus 1 may include no sound source device.

The keyboard apparatus 1 includes a keyboard assembly 10. The keyboard assembly 10 includes white keys 100*w* and black keys 100*b*. The white keys 100*w* and the black keys 100*b* are arranged side by side. The number of the keys 100 is N and 88 in this example. A direction in which the keys 100 are arranged will be referred to as "scale direction". The white keys 100*w* and the black keys 100*b* may be hereinafter collectively referred to "the key 100" in the case where there is no need of distinction between the white keys 100*w* and the black keys 100*b*. Also in the following explanation, "w" appended to the reference number indicates a configuration corresponding to the white key. Also, "b" appended to the reference number indicates a configuration corresponding to the black key. The white keys and the black keys include the same keyboard mechanism unless otherwise explained. In the following description, only the configuration of the white keys may be explained without explanation of the configuration of the black keys.

A portion of the keyboard assembly 10 is located in a space enclosed by a housing 90 and a cover 30. In the case where the keyboard apparatus 1 is viewed from an upper side thereof, a portion of the keyboard assembly 10 which is covered with the cover 30 will be referred to as "non-visible portion NV", and a portion of the keyboard assembly 10 which is exposed from the cover 30 and viewable by the player will be referred to as "visible portion PV". That is, the visible portion PV is a portion of the key 100 which is operable by the player. A portion of the key 100 which is exposed by the visible portion PV may be hereinafter referred to as "key main body portion".

The housing 90 contains a sound source device 70 and a speaker 80. The sound source device 70 is configured to create a sound waveform signal in response to pressing of the key 100. The speaker 80 is configured to output a sound based on the sound waveform signal created by the sound source device 70, to an outside space. It is noted that the keyboard apparatus 1 may include: a slider for controlling a sound volume; a switch for changing a tone color; and a display configured to display various kinds of information.

In the following description, up, down, left, right, front, and back (rear) directions respectively indicate directions in the case where the keyboard apparatus 1 is viewed from the player during playing. Thus, it is possible to express that the non-visible portion NV is located on a back side of the visible portion PV, for example. Also, directions may be represented with reference to the key 100. For example, a key-front-end side (a key-front side) and a key-back-end side (a key-back side) may be used. In this case, the key-front-end side is a front side of the key 100 when viewed from the player. The key-back-end side is a back side of the key 100 when viewed from the player.

Sound Source Device

Figure 2:
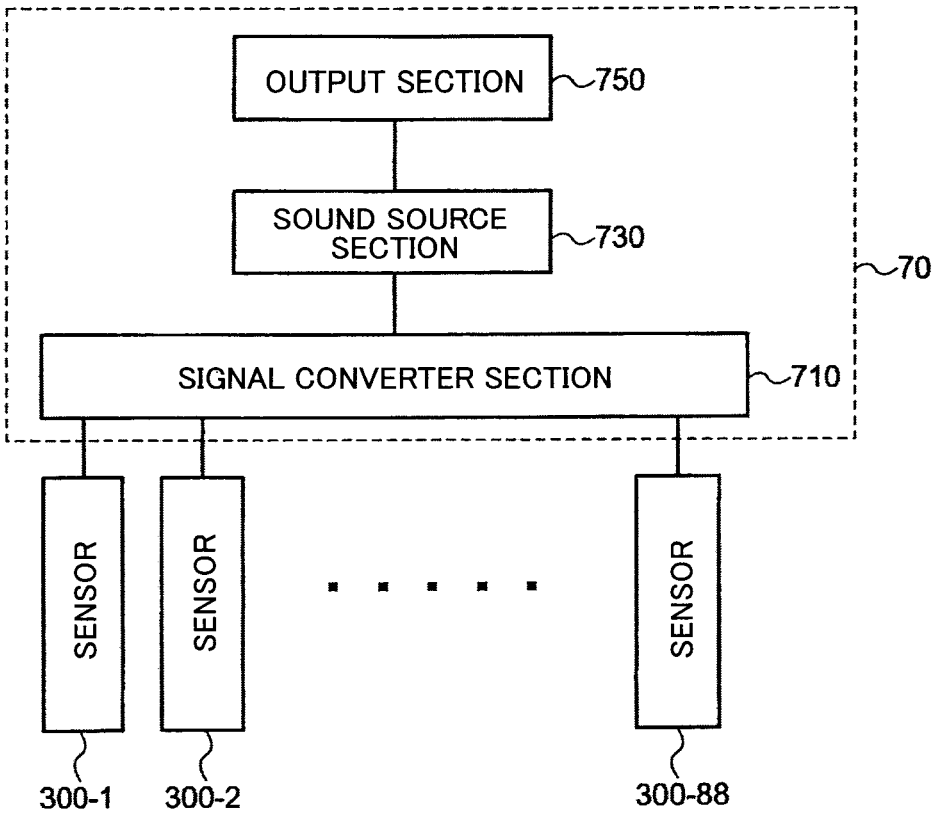
FIG. 2 is a block diagram illustrating a configuration of a sound source device.

FIG. 2 is a block diagram illustrating a configuration of the sound source device 70. The sound source device 70 includes a signal converter section 710, a sound source section 730, and an output section 750. Sensors 300 are provided corresponding to the respective keys 100. Each of the sensors 300 detects an operation of a corresponding one of the keys 100 and outputs signals in accordance with the detection. In the present example, each of the sensors 300 outputs signals in accordance with three levels of key pressing amounts. The speed of the key pressing is detectable in accordance with a time interval between the signals.

The signal converter section 710 obtains the signals output from the sensors 300 (the sensors 300-1, 300-2, . . . , 300-88 corresponding to the respective 88 keys 100) and creates and outputs an operation signal in accordance with an operation state of each of the keys 100. In the present example, the operation signal is a MIDI signal. Thus, the signal converter section 710 outputs "Note-On" when a key is pressed. In this output, a key number indicating which one of the 88 keys 100 is operated, and a velocity corresponding to the speed of the key pressing are also output in association with "Note-On". When the player has released the key 100, the signal converter section 710 outputs the key number and "Note-Off" in association with each other. A signal created in response to another operation, such as an operation on a pedal, may be output to the signal converter section 710 and reflected on the operation signal.

The sound source section 730 creates the sound waveform signal based on each of signals (the operation signals) for the respective sensors 300 which are output from the signal converter section 710. The output section 750 outputs the sound waveform signal created by the sound source section 730. This sound waveform signal is output to the speaker 80 or a sound-waveform-signal output terminal, for example.

Configuration of Keyboard Assembly

Figure 3:
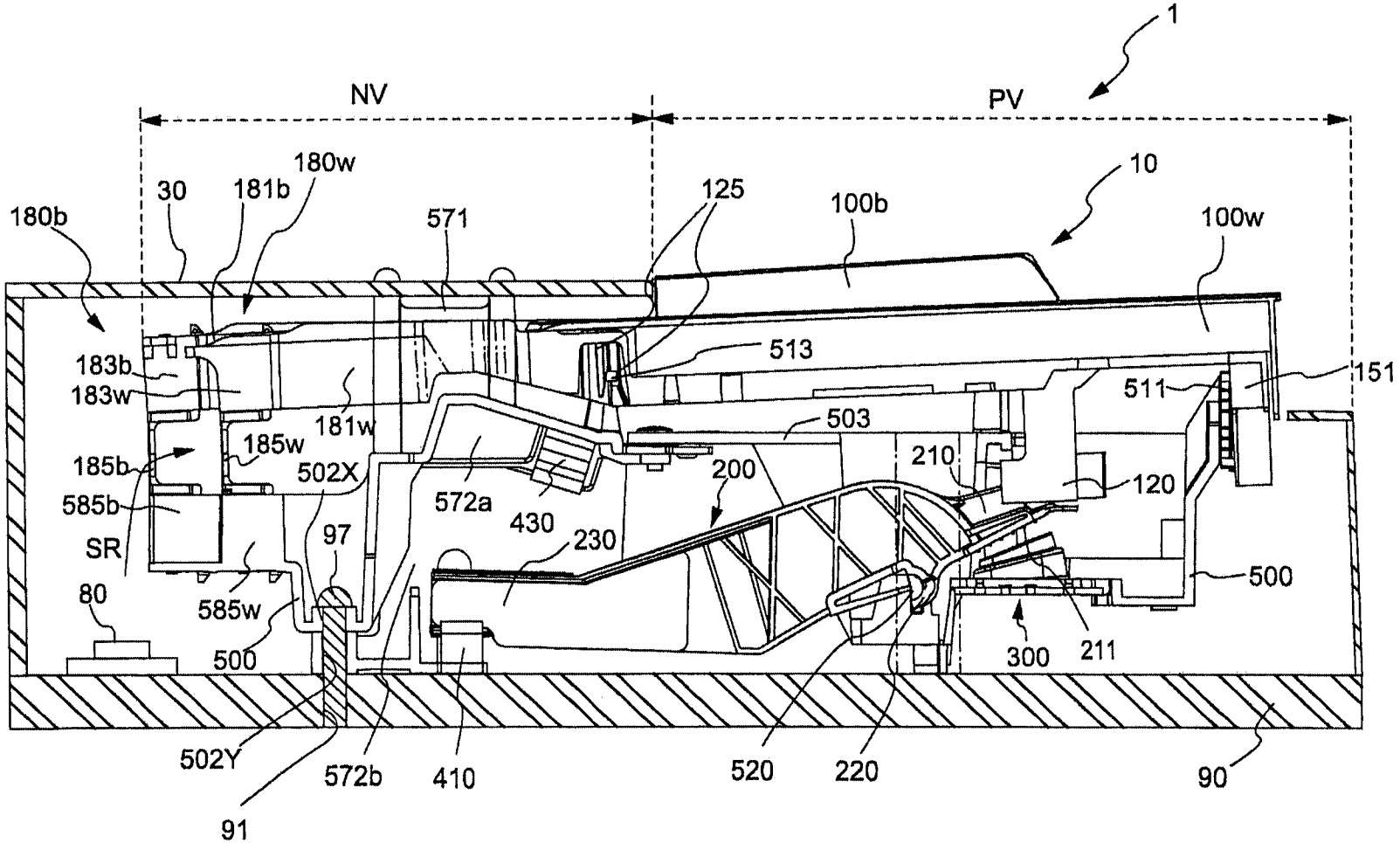
FIG. 3 is a view for explaining a configuration of the inside of a housing of the keyboard apparatus, with the configuration viewed from a lateral side of the housing.

FIG. 3 is a view for explaining a configuration of the inside of the housing 90 of the keyboard apparatus 1, with the configuration viewed from a lateral side of the housing 90. The keyboard apparatus 1 includes the housing 90 and the cover 30. The housing 90 covers a bottom surface and side surfaces of the keyboard assembly 10. The cover 30 covers portions of the keys 100 of the keyboard assembly 10. Each of the black keys 100*b* protrudes upward from each of the white keys 100*w*. The non-visible portion NV is located on the key-back-end side of this protruding portion.

The keyboard assembly 10 and the speaker 80 are disposed in the housing 90. The speaker 80 is disposed so as to output a sound, which is produced in response to pressing of the key 100, toward up and down sides of the housing 90.

The sound output downward travels toward the outside from a portion of the housing 90 near its lower surface. It is noted that a path of sounds output from the speaker 80 to a space in the keyboard assembly 10, i.e., a space below the keys 100 (the key main body portion) is indicated as a path SR.

The keyboard assembly 10 includes connecting portions 180*w*, 180*b* and hammer assemblies 200 in addition to the keys 100 and a frame 500. The keyboard assembly 10 is formed of resin, and a most portion of the keyboard assembly 10 is manufactured by, e.g., injection molding. The frame 500 is fixed to the housing 90.

The connecting portion 180*w* connects the white keys 100*w* to the frame 500 such that the white keys 100*w* are pivotable. The connecting portion 180*b* connects the black keys 100*b* to the frame 500 such that the black keys 100*b* are pivotable. In the following description, an explanation will be provided only for the white keys 100*w* among the white keys 100*w* and the black keys 100*b* of the keyboard apparatus 1, but each of the black keys 100*b* has a configuration similar to that of each of the white keys 100*w*. The connecting portion 180*w* includes plate-like flexible members 181*w*, first supporters 183*w*, and rod-like flexible members 185*w*. Each of the plate-like flexible members 181*w* extends from a rear end of a corresponding one of the white keys 100*w*. Each of the first supporters 183 extends from a rear end of a corresponding one of the plate-like flexible members 181*w*.

Each of the rod-like flexible members 185*w* is supported by a corresponding one of the first supporters 183*w* and a second supporter 585*w*. That is, the plate-like flexible member 181*w* and the rod-like flexible member 185*w* connected to each other in series are disposed between the white key 100*w* and the frame 500. Bending of the rod-like flexible member 185*w* disposed as described above allows the white key 100*w* to pivot with respect to the frame 500.

The rod-like flexible member 185*w* is mountable on and removable from the first supporter 183*w* and the second supporter 585*w*. The rod-like flexible member 185*w* and the plate-like flexible member 181*w* are different from each other in property of material. In this example, the plate-like flexible member 181*w* is harder than the rod-like flexible member 185*w*. That is, the plate-like flexible member 181*w* is bent more easily than the rod-like flexible member 185*w*. It is noted that a first supporter 183*b*, a rod-like flexible member 185*b*, a second supporter 585*b* of the black key 100*b* are similar in configuration respectively to the first supporter 183*w*, the rod-like flexible member 185*w*, the second supporter 585*w* of the white key 100*w*.

Key Guide

Each of the white keys 100*w* includes front-end key guides 151 and key-side guides 125 (as one example of a restrictor) as a key guide. In a state in which a distal end portion of the key 100 and the front-end key guides 151 cover a front portion and side portions of a frame guide 511 provided at a front end of the frame 500, side walls of the distal end portion of the key are in slidable contact with the frame guide 511 during pivotal movement of the key.

Each of the key-side guides 125 provided on the side walls of the key 100 contacts corresponding two of frame-side guides 513 between the two frame-side guides 513. A plurality of the frame-side guides 513 (as one example of a restrictor) protrude from the frame 500 in the scale direction. In this example, the frame-side guides 513 are disposed at portions of side surfaces of the key 100 which correspond to the non-visible portion NV, and the frame-side guides 513 are nearer to the front end of the key 100 than the connecting portion 180*w* (the plate-like flexible members 181*w*), but the frame-side guides 513 may be disposed at regions corresponding to the visible portion PV.

The key-side guides 125 are guided by the frame-side guides 513 and moved in the up and down direction to limit movement of the key 100 in the scale direction.

Hammer Assembly

The hammer assemblies 200 are assembled to the respective keys 100. Each of the hammer assemblies 200 is disposed in a space below a corresponding one of the keys 100 and attached to the frame 500 so as to be pivotable with respect to the frame 500. A shaft supporter 220 of the hammer assembly 200 and a pivot shaft 520 of the frame 500 are in slidable contact with each other at at least three points. A front end portion 210 of the hammer assembly 200 is located in an inner space of a hammer supporter 120 and in contact with the hammer supporter 120 slidably substantially in the front and rear direction. This sliding portion, i.e., portions of the front end portion 210 and the hammer supporter 120 which are in contact with each other, are located under the key 100 at the visible portion PV (located in front of a rear end of the key main body portion).

The hammer assembly 200 is provided with a metal weight 230 disposed on a back side of a pivot axis. In a normal state (i.e., a state in which the key 100 is not pressed), the weight 230 is placed on a lower stopper 410, and the front end portion 210 of the hammer assembly 200 pushes the key 100 upward. When the key 100 is pressed, the weight 230 moves upward and comes into contact with an upper stopper 430. The hammer assembly 200 applies a weight to key pressing by the weight 230. The lower stopper 410 and the upper stopper 430 are formed of a cushioning material (such as a nonwoven fabric and a resilient material).

The sensor 300 is attached to the frame 500 under the hammer supporter 120 and the front end portion 210. When the key 100 is pressed, a pressing portion 211 provided at a lower surface of the front end portion 210 is moved to deform the sensor 300. This deformation electrically connects a contact in the sensor, causing the sensor 300 to output detection signals.

The frame 500 includes an up-down partition 503, a rib 571 located above the up-down partition 503, and a rib 572 (572*a*, 572*b*) located below the up-down partition 503. The rib 572 includes a first rib 572*a* and a second rib 572*b*. The up-down partition 503 divides a space in the frame 500 into upper and lower spaces respectively containing the key 100 and the hammer assembly 200. A screw 97 is inserted in a hole 502Y of the second rib 572*b* and a hole 91 of the housing 90 to secure the frame 500 to the housing 90.

Configuration Outline of Load Generating Portion

Figure 4:
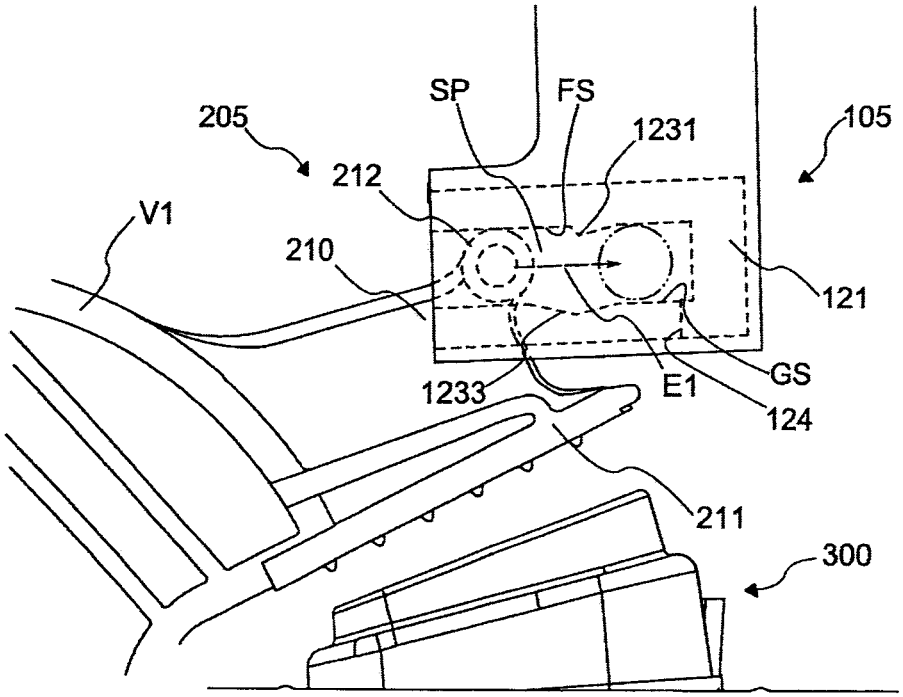
FIG. 4 is a view for explaining a load generating portion (a key-side load portion and a hammer side load portion)

FIG. 4 is a view for explaining a load generating portion (a key-side load portion and a hammer-side load portion). The hammer-side load portion 205 includes a power-point portion 212, the front end portion 210, and the pressing portion 211. These components are connected also to a pivot-mechanism portion V1. In this example, the power-point portion 212 has a substantially circular cylindrical shape, and the axis of the power-point portion 212 extends in the scale direction. The front end portion 210 is a rib connected to a lower portion of the power-point portion 212. In this example, a direction normal to a surface of the front end portion 210 is directed along the scale direction. The pressing portion 211 is a plate member provided under the front end portion 210. A direction normal to a surface of the pressing portion 211 is perpendicular to the scale direction. Here, the surface of the front end portion 210 contains a direction in which the front end portion 210 is moved by key pressing. Thus, the front end portion 210 effectively increases the strength of the power-point portion 212 and the pressing portion 211 against the direction in which the front end portion 210 is moved by key pressing.

The key-side load portion 105 has a sliding-surface forming portion 121. In this example, the sliding-surface forming portion 121 forms a space SP in which the power-point portion 212 is movable. A sliding surface FS is formed at an upper side of the space SP, and a guide surface GS is formed at a lower side of the space SP. The guide surface GS has a slit 124 allowing the front end portion 210 to pass through. A region at which at least the sliding surface FS is formed is formed by an elastic member that is formed of rubber, for example. It is noted that the power-point portion 212 is formed by a member that is formed of a material (e.g., resin having high stiffness) not easily deformed elastically when compared with the elastic member forming the sliding surface FS.

FIG. 4 indicates a position of the power-point portion 212 in the case where the key 100 is located at a rest position. When the key is pressed, a force is applied from the sliding surface FS to the power-point portion 212. The force transmitted to the power-point portion 212 causes pivotal movement of the hammer assembly 200 so as to move the weight 230 upward. In this movement, the power-point portion 212 is pressed against the sliding surface FS. When the key is pressed, the power-point portion 212 is moved the space SP in a direction indicated by arrow E1, while contacting the sliding surface FS. That is, the power-point portion 212 slides on the sliding surface FS.

In this movement, the pressing of the key moves the entire load generating portion downward, causing the pressing portion 211 to deform the sensor 300 from an upper side thereof. In this example, a step 1231 is disposed at a region on the sliding surface FS in which the power-point portion 212 is moved by pivotal movement of the key 100 from the rest position to an end position. That is, the power-point portion 212 moved from its initial position (which is a position of the power-point portion 212 when the key 100 is located at the rest position) is moved over the step 1231. Load that changes when the power-point portion 212 is moved over the step 1231 is transmitted to the key 100 and to a finger pressing the key. A recess 1233 is formed in a portion of the guide surface GS which is opposed to the step 1231. The recess 1233 makes it easy for the power-point portion 212 to move over the step 1231. When the key is released, the weight 230 falls down to cause pivotal movement of the hammer assembly 200. As a result, a force is applied from the power-point portion 212 to the sliding surface FS, and the sliding surface FS is moved in a direction opposite to the direction indicated by arrow E1.

Relationship Between Pivot Member and Weight

Overall Configuration of Hammer Assembly

Figure 5:
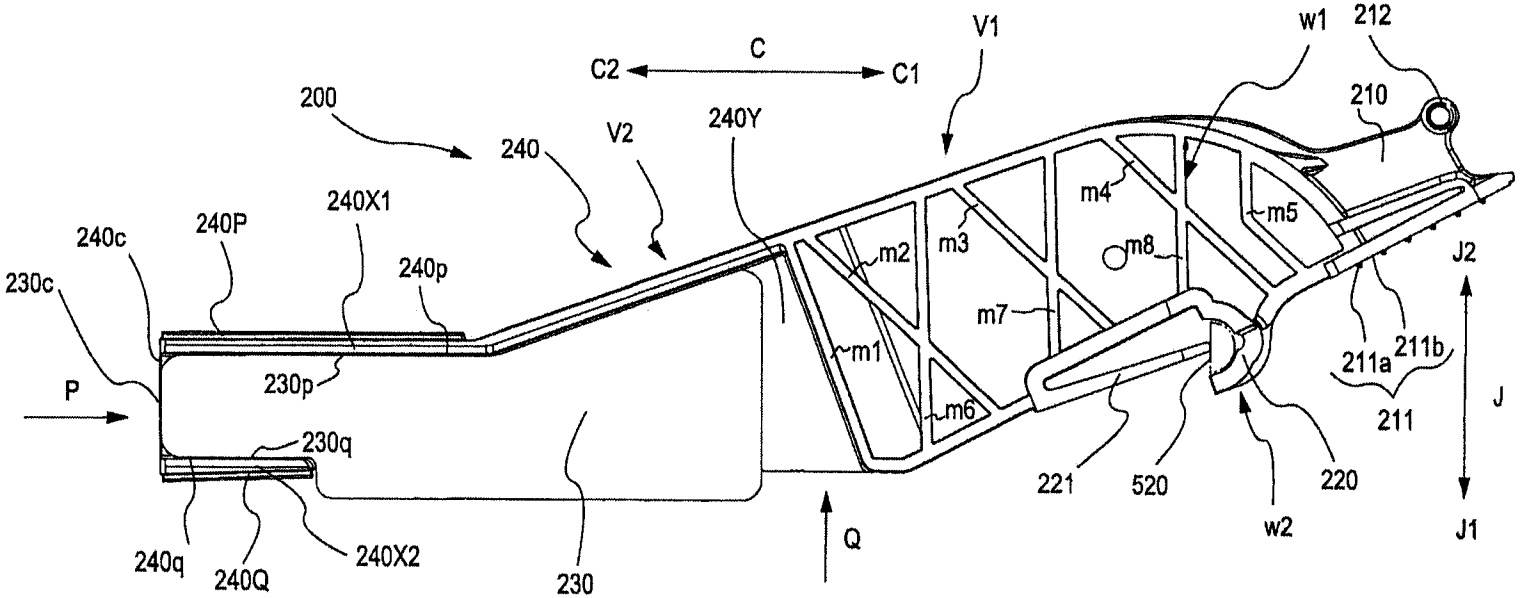
FIG. 5 is an enlarged view of a portion of a hammer assembly in FIG. 3.

FIG. 5 is an enlarged view of a portion of the hammer assembly 200 in FIG. 3. As illustrated in FIG. 5, the hammer assembly 200 includes the weight 230 and a pivot member 240 (a low-specific-gravity portion) that is formed of a material having a lower specific gravity than that of the weight 230. The weight 230 is formed of metal, and the pivot member 240 is formed of plastic. For example, the weight 230 may be formed of zinc or aluminum. The weight 230 may be manufactured by die-casting.

Pivot Member

The pivot member 240 includes the pivot-mechanism portion V1 and a weight supporting portion V2 for supporting the weight 230. Here, one end portion of the hammer assembly 200 in a direction orthogonal to the pivot shaft 520 includes the power-point portion 212, and the other end portion of the hammer assembly 200 in the direction orthogonal to the pivot shaft 520 includes the weight 230.

In the pivot member 240, the pivot-mechanism portion V1 is disposed near the power-point portion 212 in the hammer assembly 200, and the weight supporting portion V2 is disposed near the weight 230 in the hammer assembly 200. The pivot-mechanism portion V1 includes a rib portion w1, a contact and pivot portion w2, the front end portion 210, and the power-point portion 212. The rib portion w1 is disposed over most of the pivot-mechanism portion V1 and is constituted by a plurality of plate portions (ribs m1-m8) each having a surface extending in the scale direction.

Positional Relationship between Contact and Pivot Portion and Front End Portion in Pivot Member The front end portion 210 is nearer to the power-point portion 212 than the contact and pivot portion w2. The front end portion 210 includes protrusions 211*a* and the recesses 211*b* arranged in a pivot-axis-orthogonal direction C. Each of the protrusions 211*a* and the recesses 211*b* extends in the scale direction. It is noted that the pressing portion 211 of the front end portion 210 is also disposed nearer to the power-point portion 212 than the contact and pivot portion w2 in this example.

The contact and pivot portion w2 includes the shaft supporter 220 and a shaft presser 221 opposed to each other. The shaft supporter 220 is nearer to the power-point portion 212 than the shaft presser 221, and the shaft presser 221 is nearer to the weight 230 than the shaft supporter 220. The shaft supporter 220 has an inner circumferential surface having a U-shape in lateral view which opens toward the weight 230. This inner circumferential surface contacts a surface of a portion of the pivot shaft 520 provided on the frame 500, which portion is nearer to the power-point portion 212 than an other-side portion of the pivot shaft 520. The shaft presser 221 extends in a planar plate shape from a side near the weight 230 toward a side near the power-point portion 212. The shaft presser 221 is in line contact with a surface of the portion of the pivot shaft 520 which is nearer to the weight 230. The hammer assembly 200 is pivotably supported by the pivot shaft 520 in a state in which the pivot shaft 520 is held by and between the shaft supporter 220 and the shaft presser 221.

Position of Power-Point Portion with respect to Pivot Member

The power-point portion 212 and the weight 230 are located respectively on opposite sides of the shaft supporter 220. The length from the shaft supporter 220 to the power-point portion 212 is less than the length from a position nearest to the shaft supporter 220 in the weight 230, to the shaft supporter 220. Thus, the mass of the weight can be effectively used for a reaction force during pivotal movement based on the magnitude of leverage. In the present embodiment, the pressing portion 211 is disposed below the power-point portion 212 in an up and down direction J.

Figure 6A:
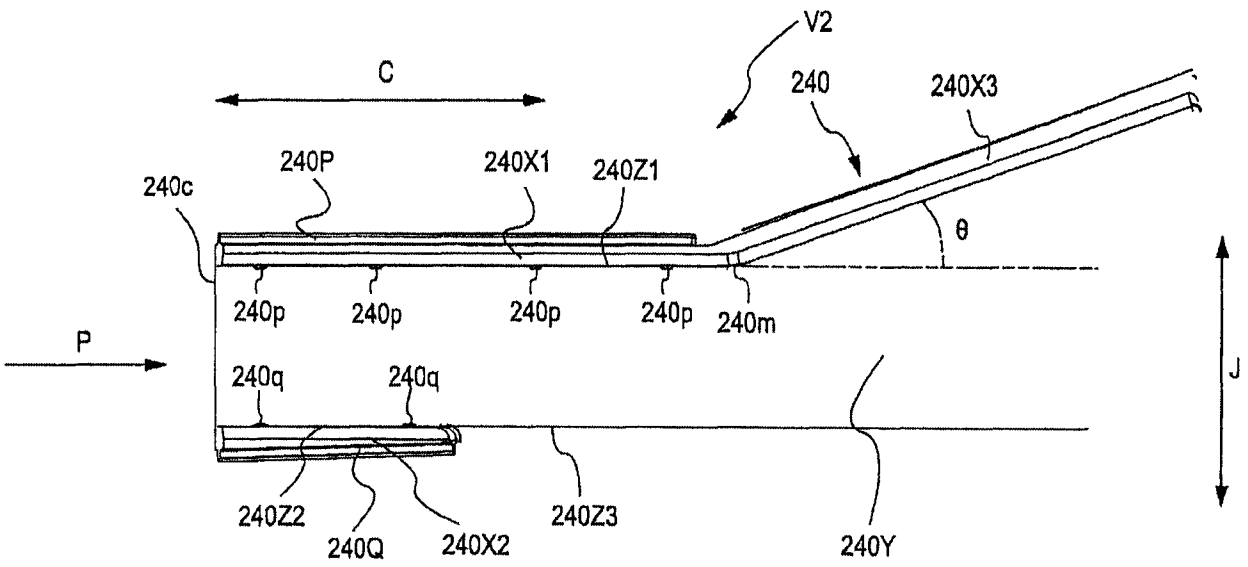
FIG. 6A is an enlarged side view of a pivot member.

FIG. 6A is an enlarged side view of the pivot member 240. As illustrated in FIG. 6A, the weight supporting portion V2 of the pivot member 240 includes a first weight supporter 240X1, a second weight supporter 240X2, and a coupling portion 240Y (an intersecting region). In the present embodiment, the dimension of the first weight supporter 240X1 in the up and down direction J is set to be greater than that of the second weight supporter 240X2 in the up and down direction J.

A first inner surface 240Z1 opposed to the second weight supporter 240X2 is formed on an inner side of the first weight supporter 240X1. The first inner surface 240Z1 is provided with first inner ribs 240*p* each extending in a pivot-axis direction M (a direction in which the pivot shaft 520 extends and a direction of extension of the axis about which the pivot member 240 pivots). The pivot-axis direction M corresponds to a direction coinciding with the scale direction and corresponds to a direction intersecting a pivot plane H on which the pivot member 240 pivots. The first inner ribs 240*p* extend in the up and down direction from the first inner surface 240Z1 toward the second weight supporter 240X2. The first inner ribs 240*p* contact an upper edge portion 230*p* of the weight 230.

The distance between the first inner ribs 240*p* is set at a predetermined distance. Here, the first weight supporter 240X1 and the second weight supporter 240X2 are provided substantially parallel with each other. An extended portion 240X3 continues to the first weight supporter 240X1 at a position nearer to the power-point portion 212 than the first weight supporter 240X1 in the pivot-axis-orthogonal direction C and located on an upper side of the first weight supporter 240X1 by a predetermined angle θ. Here, the dimension, in the up and down direction J, of a portion of the weight 230 mounted on the coupling portion 240Y at the position of the extended portion 240X3 is greater than the dimension, in the up and down direction J, of a portion of the weight 230 between the first weight supporter 240X1 and the second weight supporter 240X2.

A second inner surface 240Z2 opposed to the first weight supporter 240X1 is formed on an inner side of the second weight supporter 240X2. The second inner surface 240Z2 is provided with second inner ribs 240*q* each extending in the pivot-axis direction M. The second inner ribs 240*q* stand from the second inner surface 240Z2. These second inner ribs 240*q* contact a lower edge portion 230*q* of the weight 230. The distance between the second inner ribs 240*q* is set at a predetermined distance.

Weight

Figure 6B:
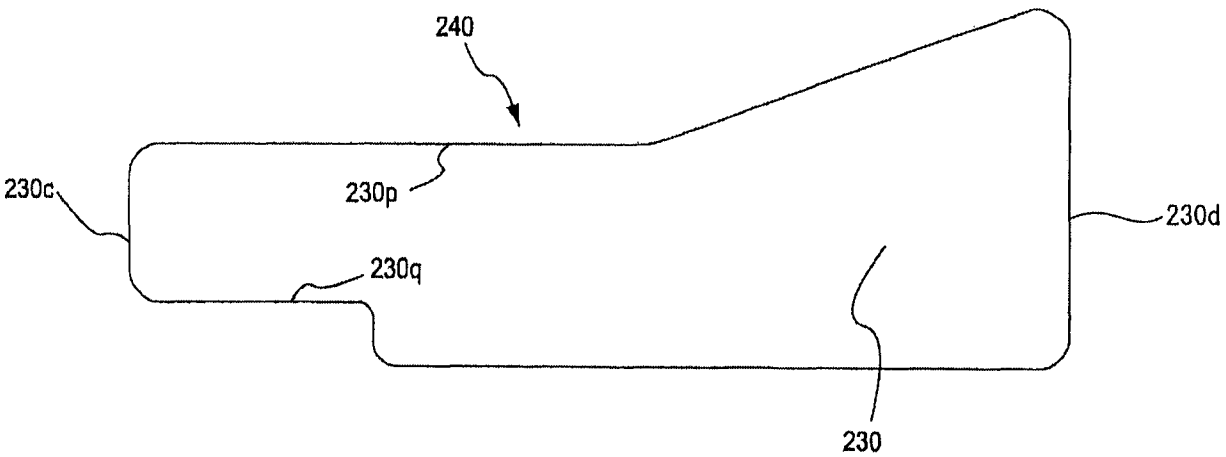
FIG. 6B is an enlarged side view of a weight.

FIG. 6B is an enlarged side view of the weight 230. The weight 230 in FIG. 6B is mounted on the coupling portion 240Y in FIG. 6A. In this operation, the upper edge portion 230*p* of the weight 230 contacts the first inner ribs 240*p* formed on the first inner surface 240Z1 of the first weight supporter 240X1. The lower edge portion 230*q* of the weight 230 contacts the second inner ribs 240*q* formed on the second inner surface 240Z2 of the second weight supporter 240X2.

A first outer rib 240P is formed on an outer surface of the first weight supporter 240X1. The first outer rib 240P extends in the pivot-axis-orthogonal direction C and protrudes in the pivotal direction. A second outer rib 240Q is formed on an outer surface of the second weight supporter 240X2. The second outer rib 240Q extends in the pivot-axis-orthogonal direction C and protrudes in the pivotal direction. In the present embodiment, the single first outer rib 240P and the single second outer rib 240Q are provided. However, a plurality of the first outer ribs 240P and/or a plurality of the second outer ribs 240Q may be provided.

An end portion 230*c* of the weight 230 which is farthest from the pivot shaft 520 is located at the same position as an end portion 240*c* of the pivot member 240 which is farthest from the pivot shaft 520. When the weight 230 pivots, a moment is applied greatly to the weight 230 in the up and down direction. The end portion 230*c* of the weight 230 and the end portion 240*c* of the pivot member 240 are disposed at the substantially same position in the present embodiment but may not be disposed at the substantially same position.

The frame 500 has the pivot shaft 520. The hammer assembly 200 is pivotably supported by the pivot shaft 520 in the state in which the pivot shaft 520 is held by and between the shaft supporter 220 and the shaft presser 221.

Figure 7B:
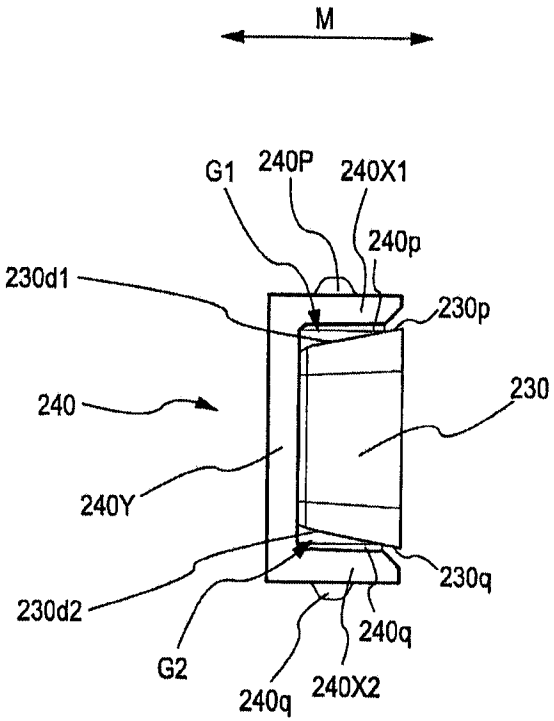
FIG. 7B is a conceptual view emphasizing that gaps exist between the pivot member and the weight based on FIG. 7A.
Figure 7A:
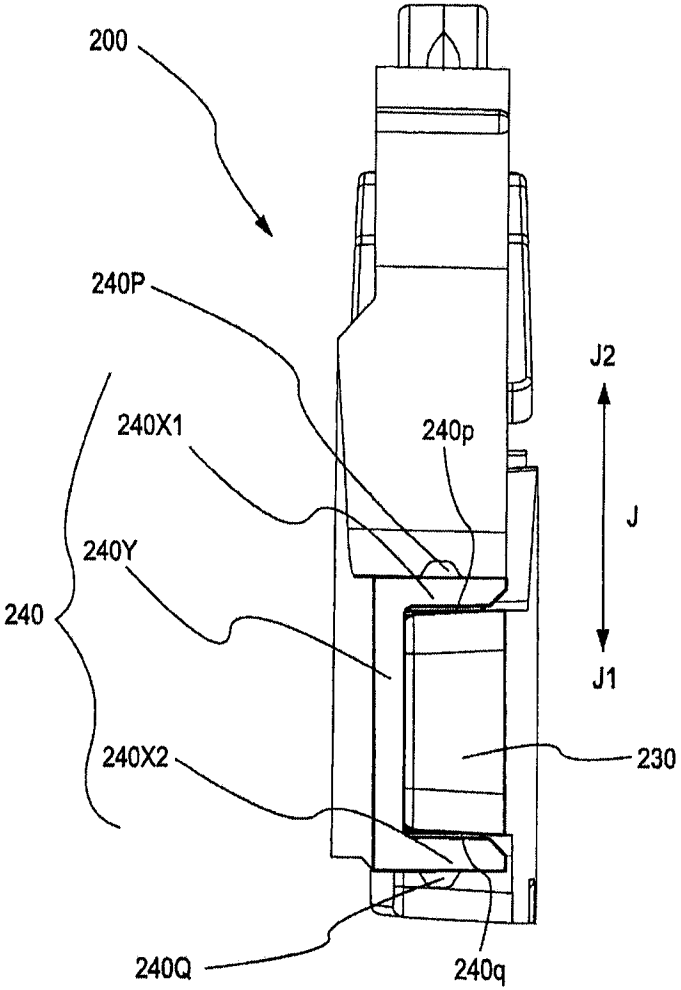

FIG. 7A is a view corresponding to a view in which FIG. 5 is viewed in a direction indicated by arrow P and in which the hammer assembly 200 is viewed from a back side. As illustrated in FIG. 7A, the first weight supporter 240X1, the second weight supporter 240X2, and the coupling portion 240Y are formed integrally with each other so as to have a substantially U-shape in cross section.

The first weight supporter 240X1 supports the weight 230 in a first direction J1 of the up and down direction J. The second weight supporter 240X2 supports the weight 230 in a second direction J2 of the up and down direction J which is opposite to the first direction J1. The coupling portion 240Y couples the first weight supporter 240X1 and the second weight supporter 240X2 to each other and is opposed to the inserted weight 230.

FIG. 7B is a conceptual view emphasizing that gaps G1, G2 exist between the pivot member 240 and the weight 230 based on FIG. 7A. As illustrated in FIG. 7B, the distance from the first weight supporter 240X1 to the weight 230 increases with decrease in distance to the coupling portion 240Y. Thus, the size of the gap G1 gradually increases with decrease in distance to the coupling portion 240Y. The distance from the second weight supporter 240X2 to the weight 230 increases with decrease in distance to the coupling portion 240Y. Thus, the size of the gap G2 gradually increases with decrease in distance to the coupling portion 240Y.

It is noted that the entire size of each of the gaps G1, G2 gradually increases in a direction directed from a 230B side toward a 230A side in this example. That is, the gaps G1, G2 extend throughout the entire plate member (the weight 230) in the thickness direction. However, the plate member may have a gap at a portion of the plate member in the thickness direction, and the size of the gap may gradually increase in the direction directed from the 230B side toward the 230A side.

Thus, the weight 230 is supported at its upper and lower portions with respect to the pivotal direction of the weight 230. In particular, the pivot member uses an elastic force to support corner portions of the weight or its portions near the corner portions. Thus, a force for supporting the weight 230 is large with respect to a force in the pivotal direction, making it difficult for the weight 230 to be separated due to impact.

Dimension of Weight

Figure 8B:
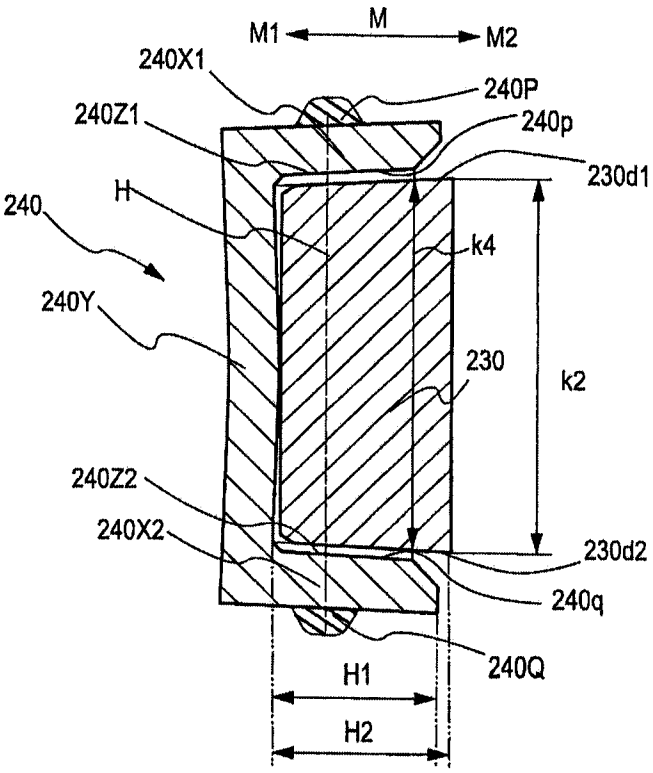
FIG. 8B is an enlarged cross-sectional view of portions of the pivot member and the weight assembled to each other.
Figure 8A:
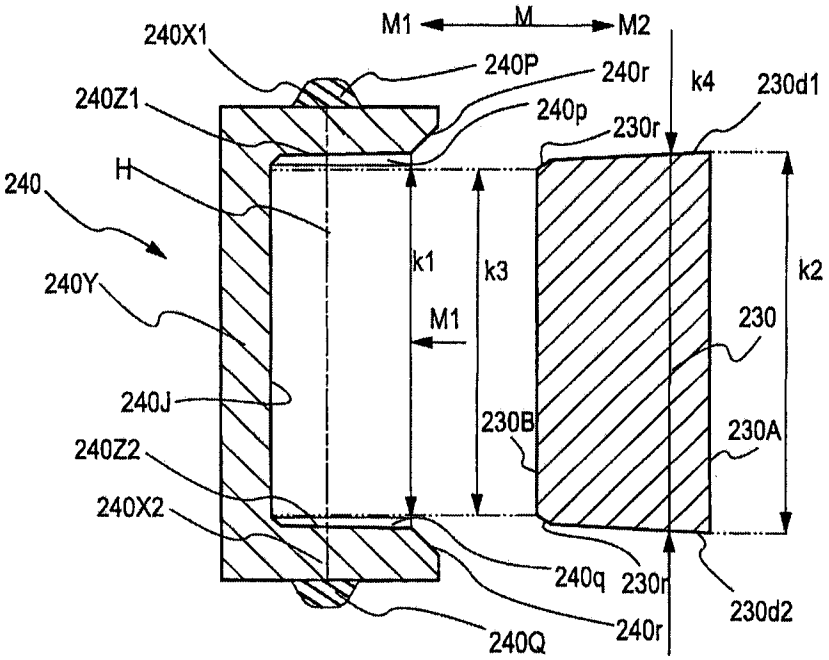
FIG. 8A is an exploded enlarged cross-sectional view of portions of the pivot member and the weight.

FIG. 8A is an exploded enlarged cross-sectional view of portions of the pivot member 240 and the weight 230. FIG. 8B is an enlarged cross-sectional view of portions of the pivot member 240 and the weight 230. The weight 230 in cross section includes: a lower bottom portion 230A having a large dimension in the up and down direction J; an upper bottom portion 230B having a small dimension in the up and down direction J; and inclined portions 230*d*1, 230*d*2 each inclined so as to connect between a corresponding one of end portions of the lower bottom portion 230A and a corresponding one of end portions of the upper bottom portion 230B. The height of the lower bottom portion 230A is a dimension k2, and the height of the upper bottom portion 230B is a dimension k3.

Dimension of Opening of Pivot Member

In contrast, when the weight 230 is assembled into an opening 240J of the pivot member 240, the assembly of the weight 230 in the pivot-axis direction M is easy because the first inner ribs 240*p* and the second inner ribs 240*q* extend in the pivot-axis direction M. When the weight 230 is removed from the opening 240J of the pivot member 240, the removal of the weight 230 in the pivot-axis direction M is easy because the first inner ribs 240*p* and the second inner ribs 240*q* extend in the pivot-axis direction M.

Here, the height between the first inner ribs 240*p* and the second inner ribs 240*q* is defined as a dimension k1. In this case, a relationship "k3<k1<k2" is satisfied. That is, when the weight 230 is mounted to the pivot member 240, the upper bottom portion 230B is easily inserted between the first inner ribs 240*p* and the second inner ribs 240*q* because of the relationship "k3<k1", and the relationship "k1<k2" causes the inclined portions 230*d*1, 230*d*2 to elastically deform the pivot member 240 to increase a distance between the first inner ribs 240*p* and the second inner ribs 240*q*. Thus, the inclined portions 230*d*1, 230*d*2 receive a reaction force against the force that increases the distance between the first inner ribs 240*p* and the second inner ribs 240*q*. That is, the direction in which the weight 230 is inserted in the pivot-axis direction M for the first inner ribs 240*p* and the second inner ribs 240*q* will be referred to as "first direction M1", and the direction in which the weight 230 is removed in the pivot-axis direction M will be referred to as "second direction M2". It is also possible to consider that the first direction M1 is a direction directed from an outside toward an inside of the opening 240J of the pivot member 240, and the second direction M2 is a direction directed from the inside toward the outside of the opening 240J of the pivot member 240.

The most-second-direction-M2 side portions of the first inner ribs 240*p* and the second inner ribs 240*q* are pressed and elastically deformed so as to change the dimension from the dimension k1 to the dimension k4, and a reaction force corresponding to a force of the deformation is applied to the weight 230. Thus, the weight is stably held with respect to the pivot member. If the dimension k2 of the height of the lower bottom portion 230A is less than the dimension k1 between the first inner ribs 240*p* and the second inner ribs 240*q*, it is difficult for the weight 230 to be held in the opening 240J.

Also, since it is enough for the opening 240J to hold the weight 230, in particular, the corner portions of the weight 230 or its portions near the corner portions, each of the first weight supporter 240X1 and the second weight supporter 240X2 need not have a width that is greater than required. Accordingly, the width H1 of the weight 230 may be less than the width H2 of the opening 240J.

In view of the above, the dimension between the first weight supporter 240X1 and the second weight supporter 240X2 is set to the dimension k1 (a first dimension) when the weight 230 is not inserted as illustrated in FIG. 8A, and the dimension between the first weight supporter 240X1 and the second weight supporter 240X2 is set to the dimension k4 (a second dimension) when the weight 230 is inserted as illustrated in FIG. 8B.

The outer surface of the first weight supporter 240X1 is provided with the first outer rib 240P that extends in the direction intersecting the pivot-axis direction M (the direction which is directed along the pivot shaft 520) and protrudes in the pivotal direction. When the first outer rib 240P contacts the upper stopper 430, it is difficult for the first weight supporter 240X1 to be slipped in the pivot-axis direction M.

The outer surface of the second weight supporter 240X2 is provided with the second outer rib 240Q that extends in the direction intersecting the pivot-axis direction M (the direction directed along the pivot shaft 520) and protrudes in the pivotal direction. When the second outer rib 240Q contacts the lower stopper 410, it is difficult for the second weight supporter 240X2 to be slipped in the pivot-axis direction M.

The direction intersecting the pivot-axis direction M (the direction directed along the pivot shaft 520) is the pivot-axis-orthogonal direction C orthogonal to the pivot-axis direction M in FIG. 8A but may contain a direction intersecting the pivot-axis direction M other than the pivot-axis-orthogonal direction C.

When the key is pressed, the hammer assembly 200 pivots, and the first weight supporter 240X1 comes into contact with the upper stopper 430 (a first stopper). The contact of the first weight supporter 240X1 with the upper stopper 430 limits the range of pivotal movement of the hammer assembly 200.

When the key is released, the hammer assembly 200 pivots, and the second weight supporter 240X2 comes into contact with the lower stopper 410 (a second stopper). The contact of the second weight supporter 240X2 with the lower stopper 410 limits the range of pivotal movement of the hammer assembly 200.

Relationship Between Pivot Member and Weight

Figure 9:
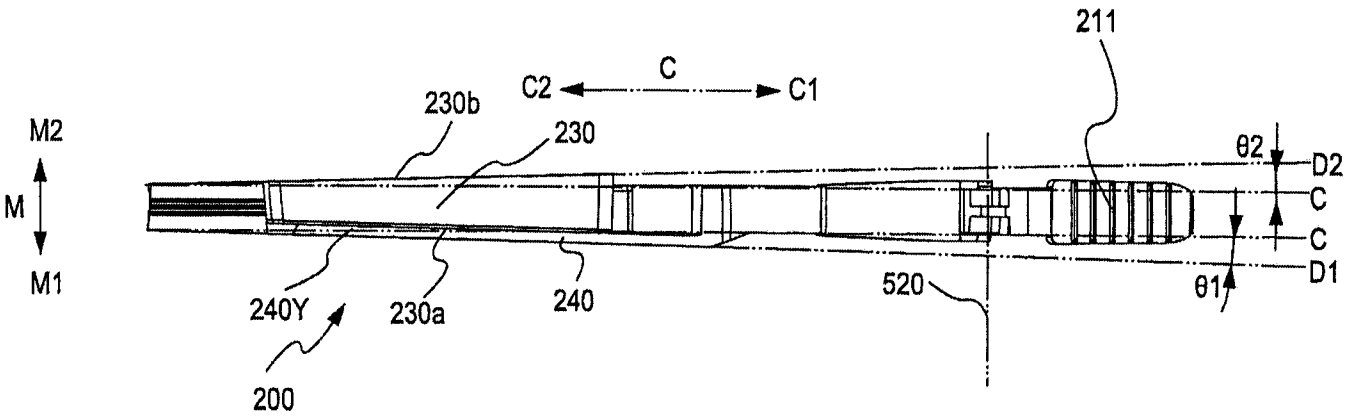

FIG. 9 is a view corresponding to a view in which FIG. 5 is viewed in a direction indicated by arrow Q and in which the hammer assembly 200 is viewed from a lower side. In FIG. 9, the pivot-axis-orthogonal direction C is orthogonal to the pivot shaft 520. As illustrated in FIG. 9, the weight 230 has: a first surface 230*a* on one side in the pivot-axis direction M; and a second surface 230*b* on the other side in the pivot-axis direction M. The first surface 230*a* is located on an imaginary intersecting plane D1 that is inclined with respect to the pivot-axis-orthogonal direction C at an angle θ1. The second surface 230*b* is located on an imaginary intersecting plane D2 that is inclined with respect to the pivot-axis-orthogonal direction C at an angle θ2.

It is noted that a first-direction-M1-side surface of the weight 230 in the pivot-axis direction M corresponds to the first surface 230*a*. A second-direction-M2-side surface of the weight 230 in the pivot-axis direction M corresponds to the second surface 230*b*. The first surface 230*a* of the weight 230 is mounted on the coupling portion 240Y of the pivot member 240. A right portion of FIG. 9 illustrates the pressing portion 211 that is a portion of the pivot member 240. This pressing portion 211 is a portion for pressing the sensor 300. The pressing portion 211 is disposed on a front side C1 of the pivot shaft 520 in the pivot-axis-orthogonal direction C.

Weight

Figure 10A:
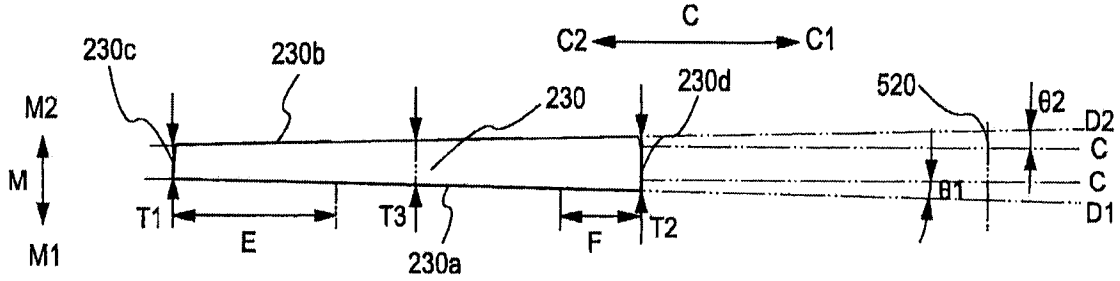
FIG. 10A is a view of the weight viewed in the direction indicated by arrow Q in FIG. 5 (viewed from a lower side)

FIG. 10A is a view of the weight 230 viewed in the direction indicated by arrow Q in FIG. 5 (viewed from a lower side). Here, the weight 230 is pivotable about the pivot shaft 520. When the pivot member 240 pivots about the pivot shaft 520, the weight 230 pivots about the pivot shaft 520 simultaneously. The weight 230 includes a plate portion extending in a plate-like shape in a direction intersecting the pivot shaft 520.

The outer shape of the plate portion of the weight 230 (an outermost circumferential portion when viewed from below) has a region in which the thickness in a direction along the pivot shaft 520 (the pivot-axis direction M) smoothly decreases with increase in distance from the pivot shaft 520. In other words, the outer shape of the weight 230 has a region in which the thickness in the pivot-axis direction M continuously decreases with increase in distance from the pivot shaft 520. For example, the width of a portion of the weight 230 which is far from the pivot shaft 520 is defined as a dimension T1 (as one example of a first thickness), the width of a portion of the weight 230 which is near the pivot shaft 520 is defined as a dimension T2 (as one example of a third thickness), and the width of a portion of the weight 230 between the portion with the dimension T1 and the portion with the dimension T2 is defined as a dimension T3 (as one example of a second thickness). In this case, a relationship "T1<T3<T2" is satisfied. That is, the dimension T1 that is a width of the plate portion at a position farthest from the pivot shaft 520 in the plate portion is less than the dimension T2 that is a width of the plate portion at a position nearer to the pivot shaft 520 than the position at which the width of the plate portion is the dimension T1. The dimension T3 that is a width of the plate portion at a position farther from the pivot shaft 520 than the position at which the width of the plate portion is the dimension T2 is less than the dimension T2. As illustrated in FIG. 6B, the length, in the up and down direction J, of the plate portion of the weight 230 at the end portion 230*c* of the plate portion which is far from the pivot shaft 520 is less than the length, in the up and down direction J, of the plate portion at an end portion 230*d* of the plate portion which is near the pivot shaft 520. Accordingly, the plate portion of the weight 230 reliably has enough weight at a position near the pivot shaft 520, and the size (the thickness and the height) of the plate portion at a position far from the pivot shaft 520 is small. This relationship will be described below. It is noted that a portion of the outer shape of the plate portion of the weight 230 may have a region in which the thickness in the direction along the pivot shaft 520 increases with increase in distance from the pivot shaft 520.

Adhesive is provided at a distance of the dimension E from the end portion 230*c* of the weight 230 which is farthest from the pivot shaft 520 in the weight 230. Adhesive is provided at a distance of the dimension F from an end portion 230*d* of the weight 230 which is nearest to the pivot shaft 520 in the weight 230.

Figure 10B:
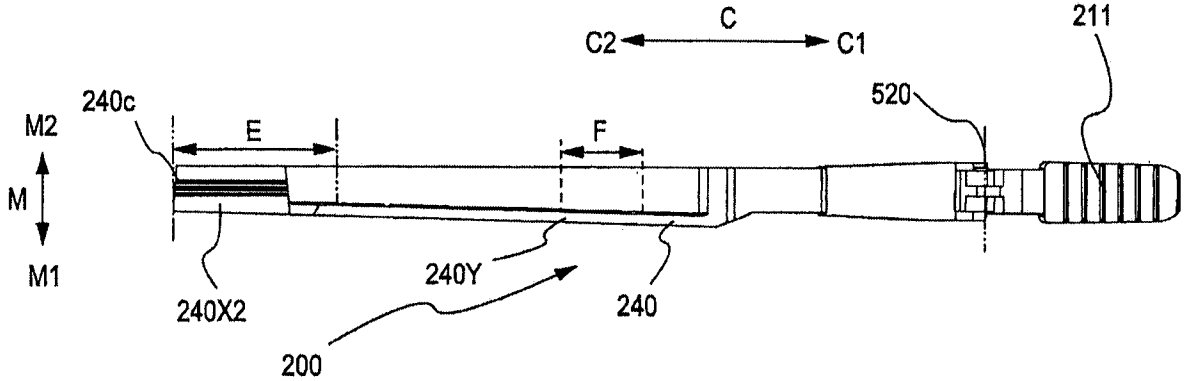
FIG. 10B is a view of the pivot member viewed in the direction indicated by arrow Q in FIG. 5 (viewed from a lower side)

FIG. 10B is a view of the pivot member 240 viewed in the direction indicated by arrow Q in FIG. 5 (viewed from a lower side). The pivot member 240 covers at least a portion of the first surface 230*a* of the weight 230 in the pivot-axis direction M.

Figure 10C:
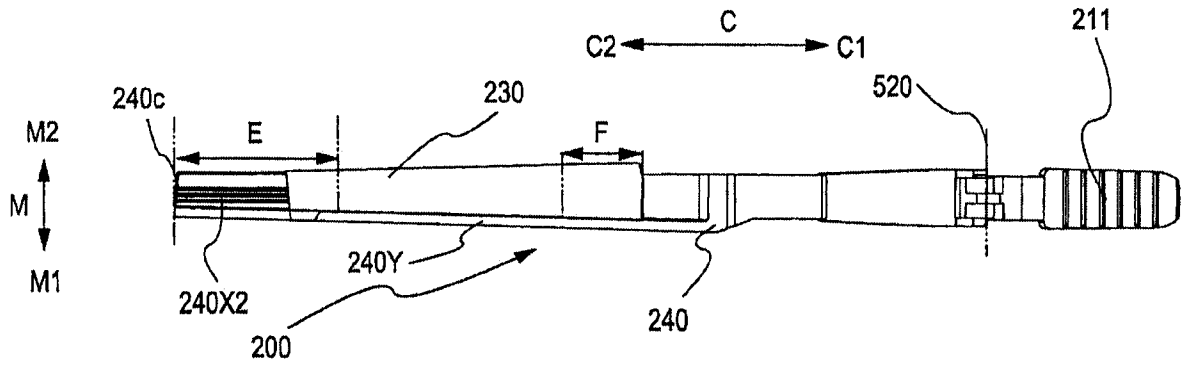
FIG. 10C is a view of a configuration in which the weight is mounted on the pivot member, which is viewed in the direction indicated by arrow Q in FIG. 5 (viewed from a lower side)

FIG. 10C is a view of a configuration in which the weight 230 is mounted on the pivot member 240, which is viewed in the direction indicated by arrow Q in FIG. 5 (viewed from a lower side). As illustrated in FIG. 10C, when the weight 230 is mounted on the pivot member 240, adhesive is applied to a region with the dimension E and a region with the dimension F on the first surface 230*a* of the weight 230, establishing a state in which the weight 230 is bonded to the pivot member 240.

Figure 11:
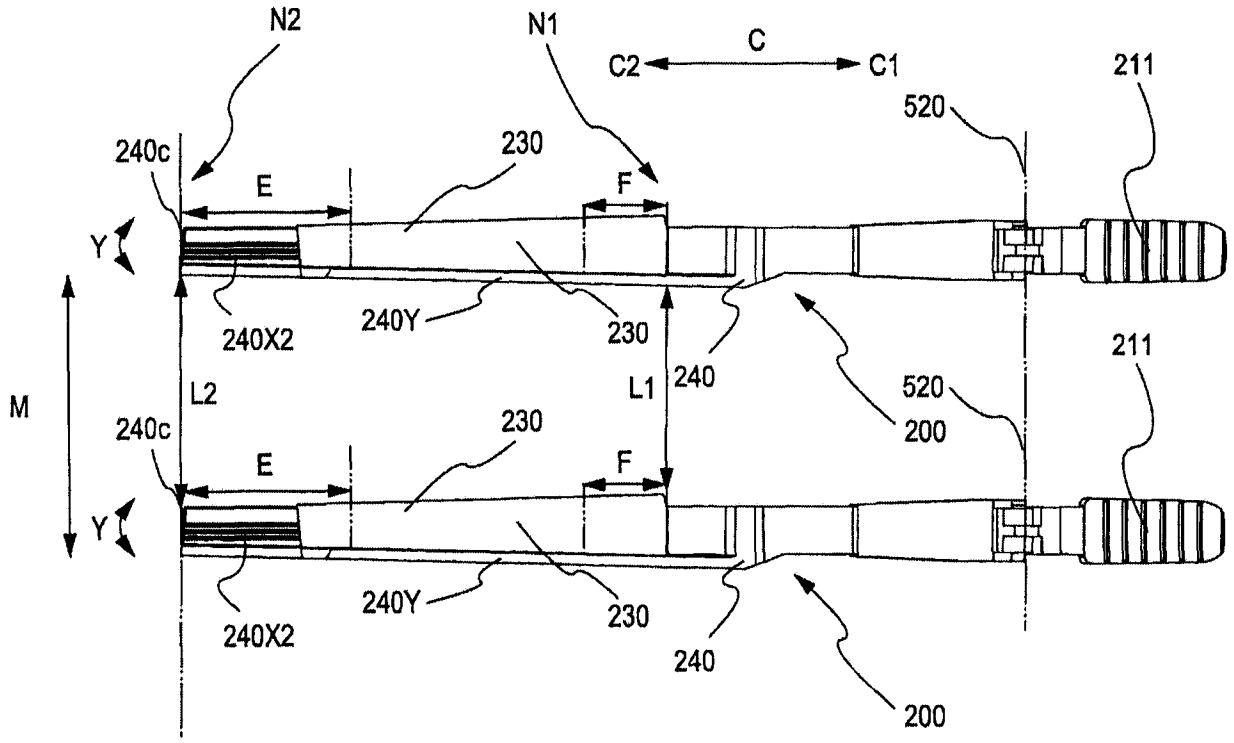
FIG. 11 is a view in which the hammer assemblies mounted on the frame are viewed from below.

FIG. 11 is a view in which the hammer assemblies 200 mounted on the frame 500 are viewed from below. As illustrated in FIG. 11, the distance in the pivot-axis direction M between the hammer assemblies 200 that pivot by key pressing and that are adjacent to each other increases with increase in distance from the pivot shaft 520.

That is, the distance in the pivot-axis direction M between the hammer assemblies 200 is a distance L1 at a position N1 nearest to the pivot shaft 520. The distance in the pivot-axis direction M between the weights 230 is a distance L2 at a position N2 farthest from the pivot shaft 520. Here, the distance L2 is greater than the distance L1. At a position near the pivot shaft 520, a distance of swing of the hammer assembly 200 in the direction R is small at a free end portion of the hammer assembly 200 about the pivot shaft 520. Thus, there is a low possibility of an occurrence of sound due to collision of the weight 230 of one of adjacent two of the hammer assemblies 200 with the pivot member 240 of the other hammer assembly 200. To solve this problem, the width of each hammer assembly 200 may be increased to reduce the distance between the hammer assemblies 200.

That is, as described with reference to FIG. 10A, allowing the smaller distance L1 leads to allowing increase in the dimension T2 in the pivot-axis direction M at a position near the end portion of the weight 230 which is nearer to the pivot shaft.

In contrast, the distance from the pivot shaft is large at a position far from the pivot shaft 520. This may increase the distance of swing of the hammer assembly 200 in the direction R. Thus, there is a high possibility of an occurrence of sound due to collision of the weight 230 of one of adjacent two of the hammer assemblies 200 with the pivot member 240 of the other hammer assembly 200. This collision sound may grate on a user's ear, for example. To avoid this, the distance between the hammer assemblies 200 is set to be large.

That is, as described with reference to FIG. 10A, since the distance L2 is preferably large, the dimension T1, in the pivot-axis direction, of the weight 230 at a position near its end portion far from the pivot shaft is preferably small.

In the present embodiment, the weight 230 of one of the adjacent hammer assemblies 200 and the pivot member 240 of the other hammer assembly 200 are opposed to each other. That is, arrangement of the weight 230, the pivot member 240, the weight 230, the pivot member 240, and so on is achieved. With this configuration, in the case where the weight 230 is formed of metal, and the pivot member 240 is formed of a material such as resin, no metallic sound having a high frequency and generated at contact between the weights 230 is not generated, and the frequency of a sound generated at contact between the weight 230 and the pivot member 240 is lower than that of the metallic sound.

Operations of Keyboard Assembly

Figure 12A:
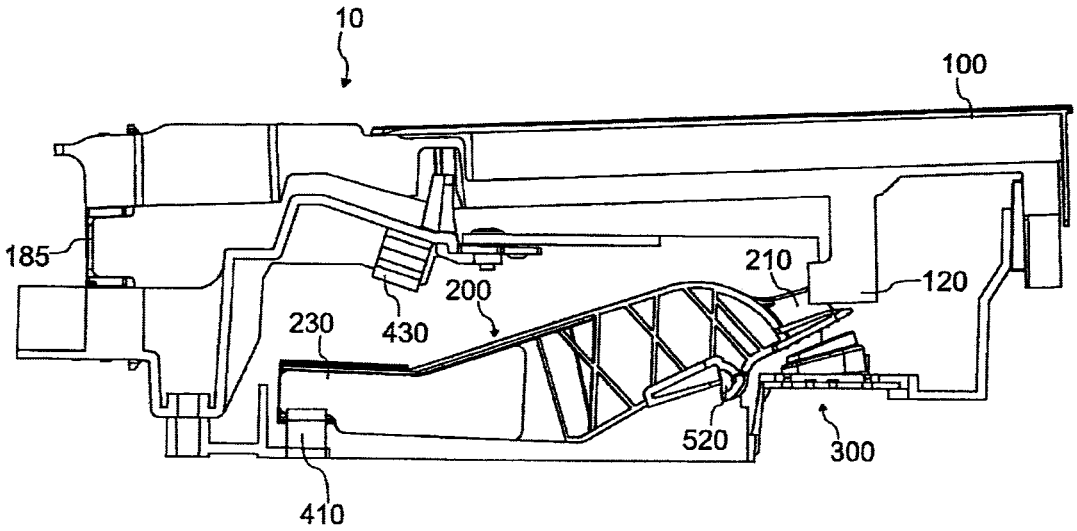
FIGS. 12A and 12B are views for explaining operations of the keyboard assembly when a key (a white key) is depressed.
Figure 12B:
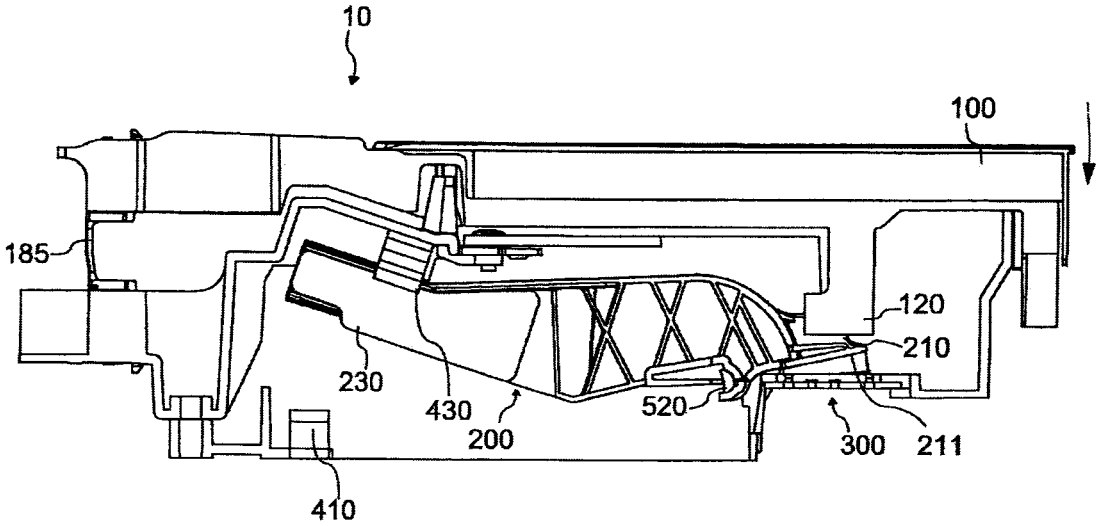

FIGS. 12A and 12B are views for explaining operations of the key assembly 10 when the key 100 (the white key) is depressed. FIG. 12A is a view illustrating a state in which the key 100 is located at a rest position (that is, the key is not depressed). FIG. 12B is a view illustrating a state in which the key 100 is located at an end position (that is, the key is fully depressed). When the key 100 is pressed, the rod-like flexible member 185 is bent. In this state, though the rod-like flexible member 185 is bent toward the front side of the key (in the front direction), the frame-side guide 513 inhibits the key 100 from moving in the front and rear direction, and thereby the key 100 pivots in a pitch direction instead of moving frontward.

The hammer supporter 120 depresses the front end portion 210, causing pivotal movement of the hammer assembly 200 about the pivot shaft 520. When the weight 230 collides with the upper stopper 430, the pivotal movement of the hammer assembly 200 is stopped, and the key 100 reaches the end position. When the sensor 300 is deformed by the front end portion 210, the sensor 300 outputs the detection signals in accordance with an amount of deformation of the sensor 300 (i.e., the key pressing amount).

When the key is released, the weight 230 moves downward, the hammer assembly 200 pivots, and the key 100 pivots upward. When the weight 230 comes into contact with the lower stopper 410, the pivotal movement of the hammer assembly 200 is stopped, and the key 100 is returned to the rest position.

Explained as operations of the hammer assembly, when the front end portion 210 is pressed downward in the state in FIGS. 6A and 6B, the shaft supporter 220 and the shaft presser 221 pivot about the pivot shaft 520, causing upward movement of the weight 230. In the state in which the front end portion 210 is not pressed downward, the weight 230 is located at its lower position as illustrated in FIGS. 6A and 6B.

Other Embodiments

There will be described various embodiments (second to sixth embodiments) and features of the shape of the weight. The thickness of the weight 230 continuously decreases with increase in distance from the pivot-shaft-520 side toward the end-portion-230*c* side (a back side C2 in the pivot-axis-orthogonal direction C) in the first embodiment but may change stepwise. As will be described below, the case where the thickness continuously decreases as in the first embodiment corresponds to a case where step change is ultimately divided into multiple changes, and accordingly it is possible to consider that the case where the thickness continuously decreases as in the first embodiment is one example of stepwise changes.

Second Embodiment

Figure 13A:
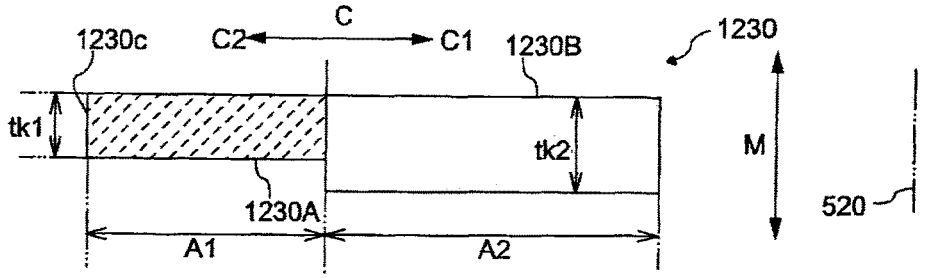
FIGS. 13A and 13B are views for explaining a weight according to a second embodiment.
Figure 13B:
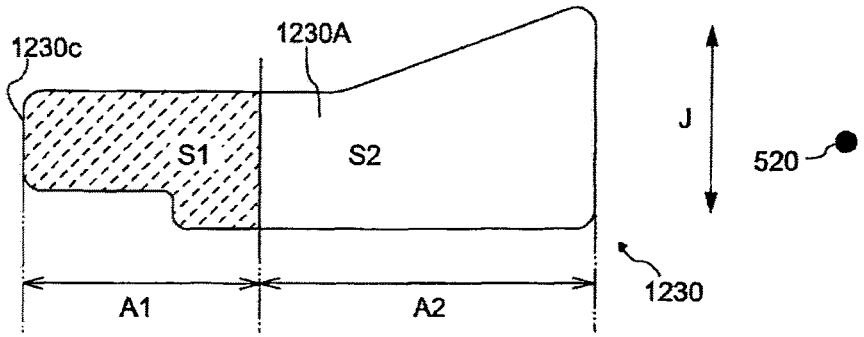

FIGS. 13A and 13B are views for explaining a weight in the second embodiment. FIG. 13A corresponds to a projected view when this weight is viewed from below (viewed in the pivotal direction). FIG. 13B corresponds to a projected view when the weight is viewed in the pivot-axis direction M. In the second embodiment, a weight 1230 has a thickness that changes in two steps. In this example, a first surface 1230A (corresponding to the lower bottom portion 230A in the first embodiment) has two surfaces connected to each other non-continuously. The length in the pivot-axis direction M between the first surface 1230A and a second surface 1230B (corresponding to the upper bottom portion 230B in the first embodiment) opposed to the first surface 1230A will be referred to as the thickness of the weight.

As illustrated in FIG. 13A, the weight 1230 is divided into: a region A1 (as one example of a first region) with a thickness tk1 (as one example of a first thickness) at an end portion 1230*c* (corresponding to the end portion 230*c* in the first embodiment); and a region A2 (as one example of a second region) with a thickness tk2 (as one example of the second thickness) greater than the thickness tk1. A step is formed between the region A1 and the region A2. As illustrated in FIG. 13B, in the case where the areas of the region A1 and the region A2 on a projected plane when the region A1 and the region A2 are viewed in the pivot-axis direction M are compared with each other, the area S1 of the region A1 is less than the area S2 of the region A2. This configuration can reduce the thickness of the distal end portion of the hammer assembly and increase the thickness of its portion nearer to the pivot shaft 520 to increase the mass.

Third Embodiment

Figure 14A:
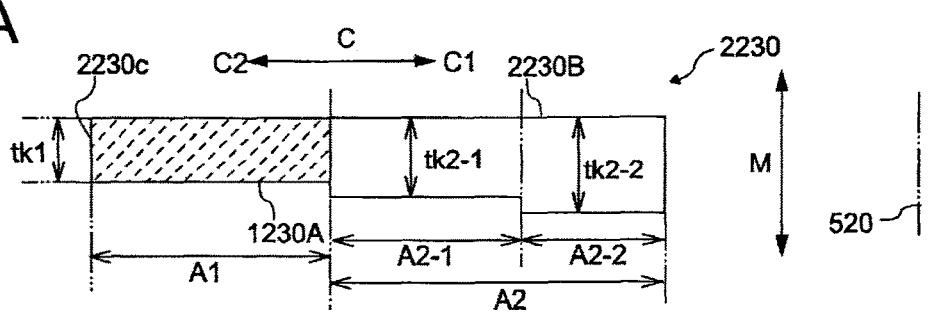
FIGS. 14A and 14B are views for explaining a weight according to a third embodiment.
Figure 14B:
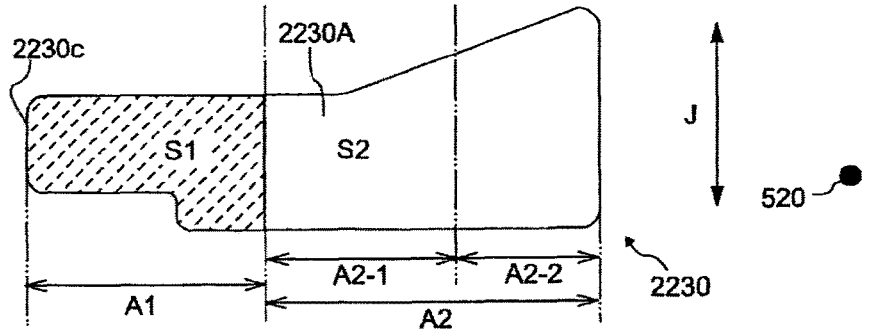

FIGS. 14A and 14B are views for explaining a weight according to the third embodiment. FIG. 14A corresponds to a projected view when this weight is viewed from below (viewed in the pivotal direction). FIG. 14B corresponds to a projected view when the weight is viewed in the pivot-axis direction M. In the third embodiment, a weight 2230 has a thickness that changes in three steps. In this example, a first surface 2230A (corresponding to the lower bottom portion 230A in the first embodiment) has three surfaces connected to each other non-continuously. The length in the pivot-axis direction M between the first surface 2230A and a second surface 2230B (corresponding to the upper bottom portion 230B in the first embodiment) opposed to the first surface 2230A will be referred to as the thickness of the weight.

As illustrated in FIG. 14A, the weight 2230 is divided into: a region A1 (as one example of the first region) with a thickness tk1 (as one example of the first thickness) at an end portion 2230*c* (corresponding to the end portion 230*c* in the first embodiment); a region A2-1 with a thickness tk2-1 (as one example of the second thickness) greater than the thickness tk1; and a region A2-2 with a thickness tk2-2 (as one example of a third thickness). The region A2 (as one example of the second region) having the thickness greater than that of the region A1 includes the region A2-1 and the region A2-2. That is, the region A2 is the entire region (the region A2-1 and the region A2-2) with a thickness greater than the thickness tk1 of the end portion 2230*c* in a plate portion of the weight 2230. It is noted that a step is formed between the region A1 and the region A2-1, and a step is formed between the region A2-1 and the region A2-2. As illustrated in FIG. 14B, in the case where the areas of the region A1 and the region A2 on a projected plane when the region A1 and the region A2 are viewed in the pivot-axis direction M are compared with each other, the area S1 of the region A1 is less than the area S2 of the region A2. This configuration can reduce the thickness of the distal end portion of the hammer assembly and increase the thickness of its portion nearer to the pivot shaft 520 to increase the mass.

Fourth Embodiment

Figure 15A:
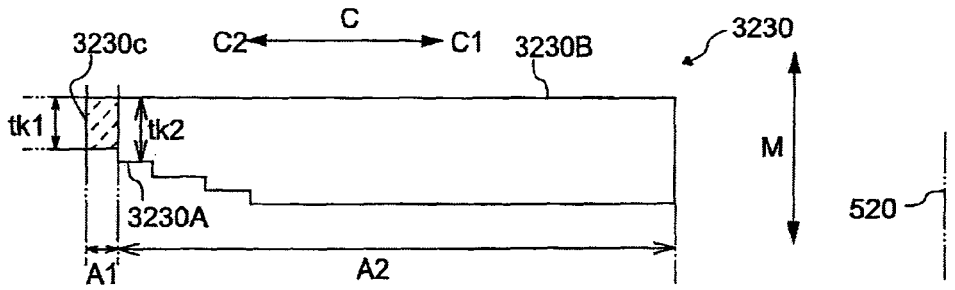
FIGS. 15A and 15B are views for explaining a weight according to a fourth embodiment.
Figure 15B:
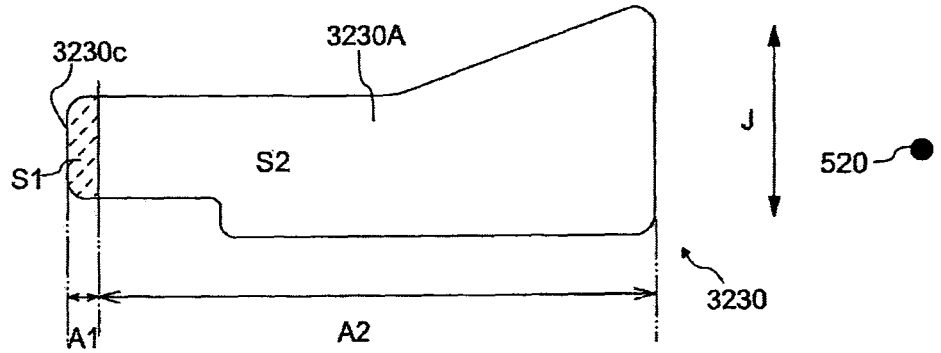

FIGS. 15A and 15B are views for explaining a weight according to the fourth embodiment. FIG. 15A corresponds to a projected view when this weight is viewed from below (viewed in the pivotal direction). FIG. 15B corresponds to a projected view when the weight is viewed in the pivot-axis direction M. In the fourth embodiment, a weight 3230 has a thickness that changes in three or more steps. In this example, a first surface 3230A (corresponding to the lower bottom portion 230A in the first embodiment) has three or more surfaces connected to each other non-continuously. The length in the pivot-axis direction M between the first surface 3230A and a second surface 3230B (corresponding to the upper bottom portion 230B in the first embodiment) opposed to the first surface 3230A will be referred to as the thickness of the weight.

As illustrated in FIG. 15A, the weight 3230 is divided into: a region A1 (as one example of the first region) with a thickness tk1 (as one example of the first thickness) at an end portion 3230*c* (corresponding to the end portion 230*c* in the first embodiment); and a region A2 (as one example of the second region) with a thickness greater than or equal to the thickness tk2 (as one example of the second thickness) that is greater than the thickness tk1. That is, the region A2 is the entire region with a thickness greater than the thickness tk1 of the end portion 3230*c* in a plate portion of the weight 3230. As illustrated in FIG. 15B, in the case where the areas of the region A1 and the region A2 on a projected plane when the region A1 and the region A2 are viewed in the pivot-axis direction M are compared with each other, the area S1 of the region A1 is less than the area S2 of the region A2. This configuration can reduce the thickness of the distal end portion of the hammer assembly and increase the thickness of its portion nearer to the pivot shaft 520 to increase the mass.

As described above, the thickness of the weight is changed more minutely and thereby changed in more steps, whereby this configuration corresponds to a configuration in which the thickness changes substantially continuously. This configuration further reduces the ratio of the area of the region A1 to that of the region A2. It is noted that the region A2 illustrated in FIGS. 15A and 15B may include a region in which the thickness is less than that in the region A1. In this case, the region in which the thickness is less than that in the region A1 is excluded from the region A2. This is because the region A2 includes only a region on the plate portion with a thickness greater than the thickness of the region A1 (the thickness tk1 of the step 3230*c*).

Fifth Embodiment

The relationship between the thickness of the weight and the area on the projected plane when viewed in the pivot-axis direction M in the second to fourth embodiments has been explained. For the fifth and sixth embodiments, there will be described examples defined as a relationship between not the thickness of the weight but the thickness of the entire hammer assembly (the weight and the pivot member) and the area on the projected plane in the pivot-axis direction M.

Figure 16A:
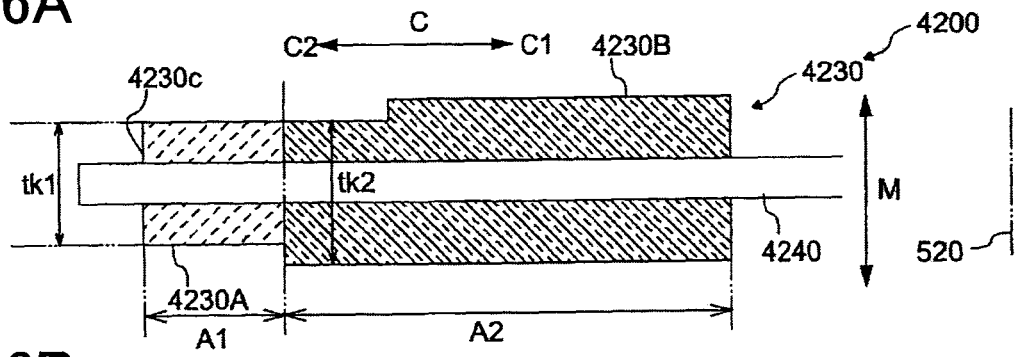
FIGS. 16A and 16B are views for explaining a hammer assembly according to a fifth embodiment.
Figure 16B:
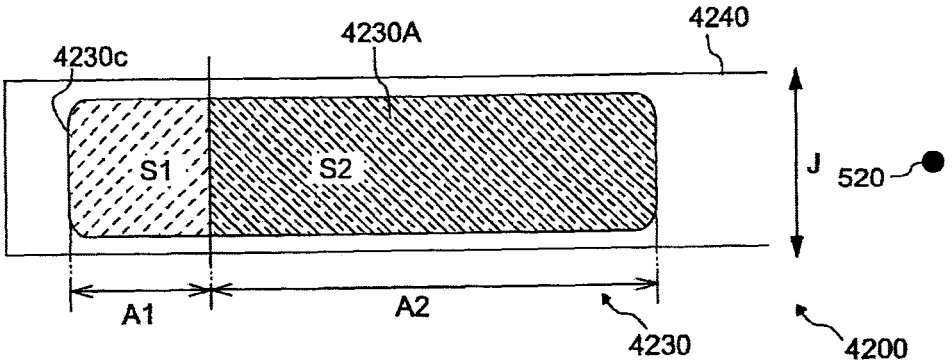

FIGS. 16A and 16B are views for explaining a hammer assembly according to the fifth embodiment. FIG. 16A corresponds to a projected view when the hammer assembly is viewed from below (in the pivotal direction). FIG. 16B corresponds to a projected view when the hammer assembly is viewed in the pivot-axis direction M. The hammer assembly 4200 according to the fifth embodiment has a thickness that changes in three steps. In this example, a weight 4230 is divided into two portions, and a pivot member 4240 is disposed between the two portions.

In this example, each of a first surface 4230A and a second surface 4230B has two surfaces connected to each other non-continuously. The length in the pivot-axis direction M between the first surface 4230A and the second surface 4230B opposed to the first surface 4230A will be referred to as the thickness of the hammer assembly.

As illustrated in FIG. 16A, the hammer assembly 4200 has a portion including the weight 4230, as a plate portion. The weight 4230 is divided into: a region A1 (as one example of the first region) with a thickness tk1 of the hammer assembly 4200 (as one example of the first thickness) at a back-side-C2 end portion of the plate portion in the pivot-axis-orthogonal direction C (which corresponds to an end portion 4230*c* of the weight 4230); and the region A2 (as one example of the second region) with a thickness greater than or equal to the thickness tk2 (as one example of the second thickness) that is greater than the thickness tk1. A step is formed between the first region A1 and the second region A2. As illustrated in FIGS. 16A and 16B, these regions A1, A2 are included in the plate portion at which the weight 4230 is disposed. It is noted that, as illustrated in FIG. 16B, in the case where the areas of the region A1 and the region A2 on a projected plane when the region A1 and the region A2 are viewed in the pivot-axis direction M are compared with each other, the area S1 of the region A1 is less than the area S2 of the region A2. This configuration can reduce the thickness of the distal end portion of the hammer assembly and increase the thickness of its portion nearer to the pivot shaft 520 to increase the mass.

Sixth Embodiment

There will be described a hammer assembly according to the sixth embodiment which is different from that according to the fifth embodiment, among the examples defined as the relationship between the thickness of the entire hammer assembly (the weight and the pivot member) and the area on the projected plane when viewed in the pivot-axis direction M.

Figure 17A:
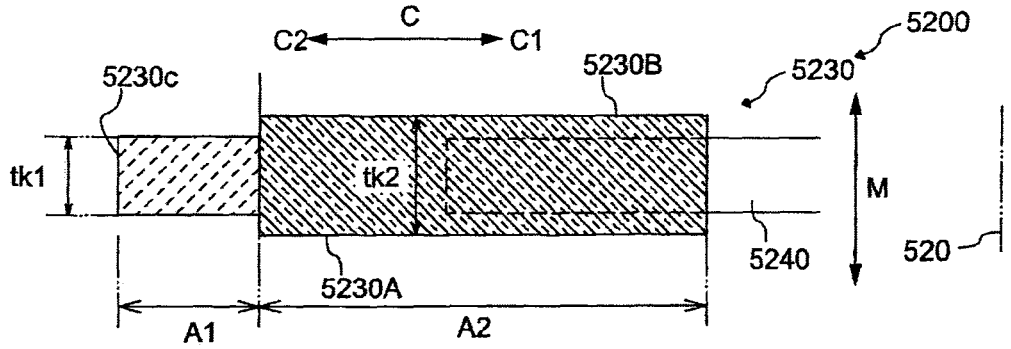
FIGS. 17A and 17B are views for explaining a hammer assembly according to a sixth embodiment.
Figure 17B:
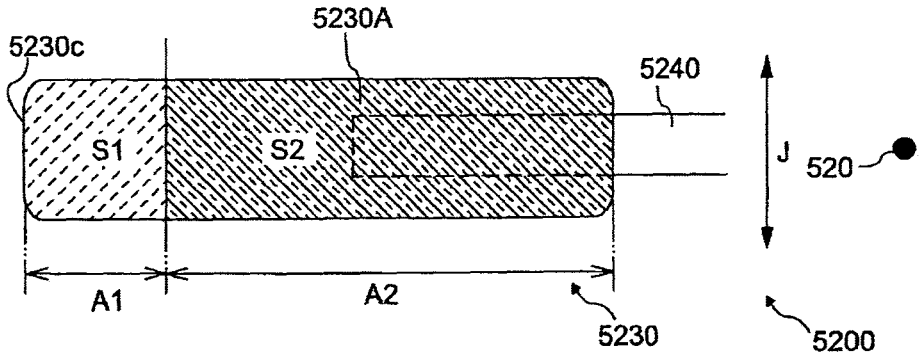

FIGS. 17A and 17B are views for explaining the hammer assembly according to the sixth embodiment. FIG. 17A corresponds to a projected view when the hammer assembly is viewed from below (in the pivotal direction). FIG. 17B corresponds to a projected view when the hammer assembly is viewed in the pivot-axis direction M. The hammer assembly 5200 according to the sixth embodiment has a thickness that changes in two steps. In this example, a pivot member 5240 is disposed in a weight 5230.

In this example, a first surface 5230A and a second surface 5230B has two surfaces connected to each other non-continuously. The length in the pivot-axis direction M between the first surface 5230A and the second surface 5230B opposed to the first surface 5230A will be referred to as the thickness of the hammer assembly.

As illustrated in FIG. 17A, the hammer assembly 5200 has a portion including the weight 5230, as a plate portion. The weight 5230 is divided into: a region A1 (as one example of the first region) with the thickness tk1 of the hammer assembly 5200 at a back-side-C2 end portion of the plate portion in the pivot-axis-orthogonal direction C (which corresponds to an end portion 5230*c* of the weight 5230); and a region A2 (as one example of the second region) with a thickness greater than or equal to the thickness tk2 that is greater than the thickness tk1. A step is formed between the region A1 and the region A2. As illustrated in FIGS. 17A and 17B, these regions A1, A2 are included in the plate portion at which the weight 5230 is disposed. In this example, a portion of the region A2 has a region at which the pivot member 5240 is disposed in the weight 5230. It is noted that, as illustrated in FIG. 17B, in the case where the areas of the region A1 and the region A2 on a projected plane when the region A1 and the region A2 are viewed in the pivot-axis direction M are compared with each other, the area S1 of the region A1 is less than the area S2 of the region A2. This configuration can reduce the thickness of the distal end portion of the hammer assembly and increase the thickness of its portion nearer to the pivot shaft 520 to increase the mass.

Modifications

The embodiments may be combined and replaced with each other. Also, the above-described embodiments may be modified as follows.

(1) The side nearer to the power-point portion 212 corresponds to the front side C1, and the side nearer to the weight 230 corresponds to the back side C2 in the above-described embodiments, the present disclosure is not limited to this configuration. That is, the side nearer to the power-point portion 212 and the side nearer to the weight 230 may correspond to the back side C2 and the front side C1, respectively.

(2) While the hammer assembly 200 is driven by the key 100 in the above-described embodiment, the present disclosure is not limited to this configuration. For example, the hammer assembly 200 may be driven by another action member (e.g., a jack or a support constituting an action mechanism of an acoustic piano). As the configuration of the hammer assembly, arrangement of a pivot shaft supporter (e.g., the shaft supporter 220), a portion that receives a force from another component (e.g., the key 100), a sensor driving portion (e.g., the pressing portion 211), and a weight (e.g., the weight 230) is not limited to the above-described embodiments and may be designed as needed in accordance with the configuration of the keyboard. All the functions of the hammer assembly 200 according to the present embodiment need not always be provided, and the configuration may be designed as needed. For example, the sensor driving portion may be omitted in the case where the key drives the sensor.

(3) The keyboard mechanism of the keyboard instrument which produces a sound based on a signal output from the sound source device 70 in response to an operation of the key 100 is taken as an example in the above-described embodiment, but the present disclosure is not limited to this configuration. For example, the present disclosure may be applied to a keyboard mechanism of an acoustic musical instrument which strikes a string or a sound board, for example, to produce a sound in response to an operation of the key 100. In this case, the outer rib may be configured to strike a struck member as a sound producing member.

(4) The above-described embodiments are described assuming that the length between the first surface and the second surface in the pivot-axis direction at the portion farthest from the pivot shaft is constant in the up and down direction J defined in the specification (that is, the thickness is constant, and the thickness tk1 is constant in the up and down direction J), but the length may change in the up and down direction J. In this case, the first region at least needs to be defined by selecting a position with the predetermined length. For example, a region at which the length between the first surface and the second surface in the pivot-axis direction at the portion farthest from the pivot shaft is longest may be determined as the first region.

(5) The weight and the pivot member may be formed of the same material and constructed integrally in the hammer assemblies according to the above-described embodiments. That is, the present disclosure may be applied not only to the hammer assemblies but also to a hammer as a single unit configured by a single member containing the weight and the pivot member.

What is claimed is:

1. A hammer assembly, comprising:

a pivot member configured to pivot about a pivot axis; and a weight supported by the pivot member and comprising a plate portion extending in a direction intersecting the pivot axis, the weight having a specific gravity greater than that of the pivot member, wherein the plate portion comprises a first surface and a second surface opposite to the first surface, and wherein the plate portion comprises: a first region with a thickness defined by a length between the first surface and the second surface in a pivot-axis direction at a portion farthest from the pivot axis; and a second region with a thickness greater than that in the first region, and in a case where the areas of the first region and the second region on a projected plane when the first region and the second region are viewed in the pivot-axis direction are compared with each other, the area of the first region is less than the area of the second region.

2. A hammer assembly, comprising:

a pivot member configured to pivot about a pivot axis; and a weight supported by the pivot member and having a specific gravity greater than that of the pivot member, wherein the hammer assembly further comprises a plate portion comprising at least the weight and extending in a direction intersecting the pivot axis, wherein the plate portion comprises a first surface and a second surface opposite to the first surface, and wherein the plate portion comprises: a first region with a thickness defined by a length between the first surface and the second surface in a pivot-axis direction at a portion farthest from the pivot axis; and a second region with a thickness greater than that in the first region, and in a case where the areas of the first region and the second region on a projected plane when the first region and the second region are viewed in the pivot-axis direction are compared with each other, the area of the first region is less than the area of the second region.

3. The hammer assembly according to claim 1, wherein the pivot member is configured to cover at least a surface of a portion of the weight, which surface extends in a direction directed along the pivot axis.

4. The hammer assembly according to claim 1, wherein the first region is a region with a first thickness that is a length between the first surface and the second surface in the pivot-axis direction at a portion of the plate portion which is located farthest from the pivot axis in the plate portion, and wherein the second region is an entire region with a thickness greater than the first thickness in the plate portion.

5. The hammer assembly according to claim 4, wherein the second region comprises: a region with a second thickness greater than the first thickness; and a region with a third thickness greater than the second thickness.

6. The hammer assembly according to claim 5, wherein the region with the third thickness is located nearer to the pivot axis than the region with the second thickness in the second region.

7. The hammer assembly according to claim 6, wherein a step is formed between the region with the third thickness and the region with the second thickness.

8. A keyboard instrument, comprising:

a plurality of hammer assemblies each as the hammer assembly according to claim 1; and a plurality of keys each configured to cause pivotal movement of a corresponding one of the plurality of hammer assemblies when pressed.

9. The keyboard instrument according to claim 8, wherein a distance, in the direction directed along the pivot axis, between adjacent two of the plurality of hammer assemblies increases with increase in distance from the pivot axis.

10. A hammer configured to pivot about a pivot axis, the hammer comprising a plate portion extending in a direction intersecting the pivot axis, wherein the plate portion comprises a first surface and a second surface opposite to the first surface, and wherein the plate portion comprises: a first region with a thickness defined by a length between the first surface and the second surface in a pivot-axis direction at a portion farthest from the pivot axis; and a second region with a thickness greater than that in the first region, and in a case where the areas of the first region and the second region on a projected plane in the pivot-axis direction are compared with each other, the area of the first region is less than the area of the second region.

11. A hammer assembly, comprising:

a pivot member configured to pivot about a pivot axis; and a weight supported by the pivot member and comprising a plate portion extending in a direction intersecting a pivot-axis direction in which the pivot axis extends, the weight having a specific gravity greater than that of the pivot member, wherein a thickness of the plate portion which is defined by a length in the pivot-axis direction between a first surface of the plate portion and a second surface of the plate portion which is opposite to the first surface is a first thickness at a first position farthest from the pivot axis in the plate portion, and the thickness of the plate portion is a second thickness greater than the first thickness at a second position located nearer to the pivot axis than the first position.

12. The hammer assembly according to claim 11, wherein the thickness of the plate portion is a third thickness greater than the second thickness, at a third position located nearer to the pivot axis than the second position.

13. The hammer assembly according to claim 11, wherein a length of the plate portion in an up and down direction at the third position is greater than a length of the plate portion in the up and down direction at the first position.

* * * * *